US006332347B1

(12) United States Patent
Gomi

(10) Patent No.: US 6,332,347 B1
(45) Date of Patent: Dec. 25, 2001

(54) APPARATUS FOR FULL-ENCLOSED DIE FORGING

(75) Inventor: Kazuhiko Gomi, Hirakata (JP)

(73) Assignee: Kabushiki Kaisha Sakamura Kikai Seisakusho, Osaka (JP)

( * ) Notice: Subject to any disclaimer, the term of this patent is extended or adjusted under 35 U.S.C. 154(b) by 0 days.

(21) Appl. No.: 09/658,569

(22) Filed: Sep. 8, 2000

(30) Foreign Application Priority Data

Sep. 10, 1999 (JP) ..... 11-256651

(51) Int. Cl.[7] ..... B21J 13/02
(52) U.S. Cl. ..... 72/355.6
(58) Field of Search ..... 72/354.6, 354.8, 72/355.2, 355.6, 357

(56) References Cited

U.S. PATENT DOCUMENTS 5,813,272 * 9/1998 Gomi ..... 72/354.8

FOREIGN PATENT DOCUMENTS

39771/1991 3/1989 (JP) .
15844/1994 3/1994 (JP) .
85955/1994 11/1994 (JP) .

* cited by examiner

*Primary Examiner*—Lowell A. Larson
(74) *Attorney, Agent, or Firm*—Barnes & Thornburg

(57) ABSTRACT

An apparatus for full-enclosed die forging for forging a material into a workpiece having concavities on its opposite end surfaces including a first die provided on a stationary frame. A second die is provided on a movable frame which moves toward and away from the stationary frame to come into and out of contact with the first die. A first punch on the stationary frame and a second punch on the movable frame plunge into a cavity formed by the closed pair of these dies from the opposite sides. The first die is movable in a forging direction in a die housing provided on the stationary frame and is forced to the second die by a first spring member in the die housing. A plurality of die engaging members are housed in the die housing, and are disposed at the surrounding of the first die and are biased into the die housing. The second die is attached to a slide member provided slidably in the forging direction on the movable frame and is forced together with the slide member to the first die by a second spring member. A thrusting portion on the slide member is provided for thrusting the die engaging members inside the die housing to engage the die engaging members with the first and the second dies after the first die and the second die are closed to each other in the process of the advancement of the movable frame. A differential mechanism causes the slide member to move forward according to the advancement movement of the movable frame slower than the movable frame after the die engaging members are engaged with the first and the second dies. With the first punch fixed and the second punch on the movable frame side advancing integrally with the movable frame, this allows the first and second dies to advance integrally with the slide member to move toward the first punch at a speed slower than that of the second punch.

6 Claims, 25 Drawing Sheets

APPARATUS FOR FULL-ENCLOSED DIE FORGING

BACKGROUND OF THE INVENTION

1. Field of the Invention

The present invention relates to a forging apparatus for forming various kinds of metallic parts, and more particularly, to improvement in a full-enclosed die forging apparatus.

2. Description of the Related Art

A full-enclosed die forging apparatus is well known in which a cavity is formed by an enclosed pair of a stationary die and a movable die that moves toward and away from the stationary die, a punch is plunged into the cavity toward the stationary die to form a material into such a workpiece of a predetermined configuration as a gear and the workpiece is ejected by a knockout system.

Generally, the knockout system is arranged on the side of the stationary die to, after plunging the punch into the stationary die, make the punch move away from the stationary die, as well as pushing and ejecting the material pressed into the stationary die by a knockout pin. In some of forging apparatus of this kind, a material has its one end pressed at the side of the movable die. In this case, since one end of the material will be pressed also into the movable die, the knockout system is arranged on the side of the movable die to push off the material from the movable die by the knockout pin as disclosed in Japanese Utility Model Laid-Open No. 15844/1994.

For forming a workpiece having concavities on its opposite end surfaces or projections on its peripheral surface by a full-enclosed die forging apparatus of this kind, the punches should be plunged into the cavity from the opposite sides, the stationary die side and the movable die side. In this case, however, designing the apparatus to make both the punches move results in having a very complicated structure.

On the other hand, in a case where with one punch fixedly plunged into the cavity by a predetermined length, plunging the other punch into the cavity to form concavities on the opposite ends of a material or projections on its peripheral surface within the cavity of the pair of dies causes a problem that a workpiece cannot be forged satisfactorily because the material of the workpiece may be pressed only from the side of the other punch to make the material flow insufficient in the cavity, as well as making the flow remarkably uneven on the opposite ends of the material.

Under these circumstances, put into practice is such a forging apparatus as shown in FIG. 27, in which with a material Z held at the center of a cavity X by a pair of punches Y1 and Y2, one punch Y2 is moved toward the other punch Y1 by a predetermined length (L), while the cavity X itself is also moved by, for example, half the predetermined length (L), thereby equally pressing the material Z from its opposite ends by the pair of punches Y1 and Y2. Among apparatuses adopting such a differential mechanism are those disclosed in Japanese Patent Publication No. 39711/1991 and No. 85955/1994.

These forging apparatuses employing the differential mechanism are all provided with a pair of dies, an upper die and a lower die which are allowed to move toward and away from each other, a pair of cylinders, an upper cylinder and a lower cylinder which respectively force the upper die and the lower die to a direction which makes them closed, and a pair of punches, an upper punch and a lower punch which pass through these dies, respectively. The apparatus is further provided with a differential mechanism for, with the lower punch fixed and the upper punch mounted to a slide which supports the upper die, bringing down the upper and lower dies while maintaining their closed state according to a fall of the upper punch integrated with the slide and at a speed lower than the moving speed of the slide.

According to the mechanism, with a material supplied to the pair of dies, the upper and the lower dies are closed by the respective cylinders to form a closed cavity housing the material. At this state, when the slide moves downward, the cavity will move downward through the differential mechanism, so that, while the lower punch plunges into the cavity from below, the upper punch relatively plunges into the cavity from above at a speed higher than the moving-down speed of the cavity. Therefore, the material in the cavity is approximately equally pressed from above and below to form a workpiece satisfactorily.

However, any of the above-described differential-type full-enclosed die forging apparatuses requires, in addition to a driving means for driving the slide to move up and down, a pair of cylinders for closing the upper and the lower dies and a differential mechanism for bringing down the closed pair of dies according to the moving-down of the slide and at a speed lower than the moving speed of the slide. Furthermore, the cylinders and the slide should be driven in the apparatus. These factors make structure of the apparatus be complicated and be increased in scale, as well as making its operation complicated. Therefore, it is difficult to apply the apparatuses disclosed in the literature as one station of a multi-stage forging apparatus which has a plurality of forging stations working synchronously with each other.

SUMMARY OF THE INVENTION

An object of the present invention is to realize a differential-type full-enclosed die forging apparatus whose structure and operation are simple, and more particularly, to provide a full-enclosed die forging apparatus which is applicable to a multi-stage forging apparatus with ease.

The above and other objects, features and advantages of the present invention will become more apparent from the following detailed description of the preferred embodiments of the present invention in conjunction with the accompanying drawings.

DETAILED DESCRIPTION OF THE PREFERRED EMBODIMENT

A full-enclosed forging apparatus of the present invention will now be described by way of preferred embodiments with reference to the accompanying drawings in the following.

Figure 1:
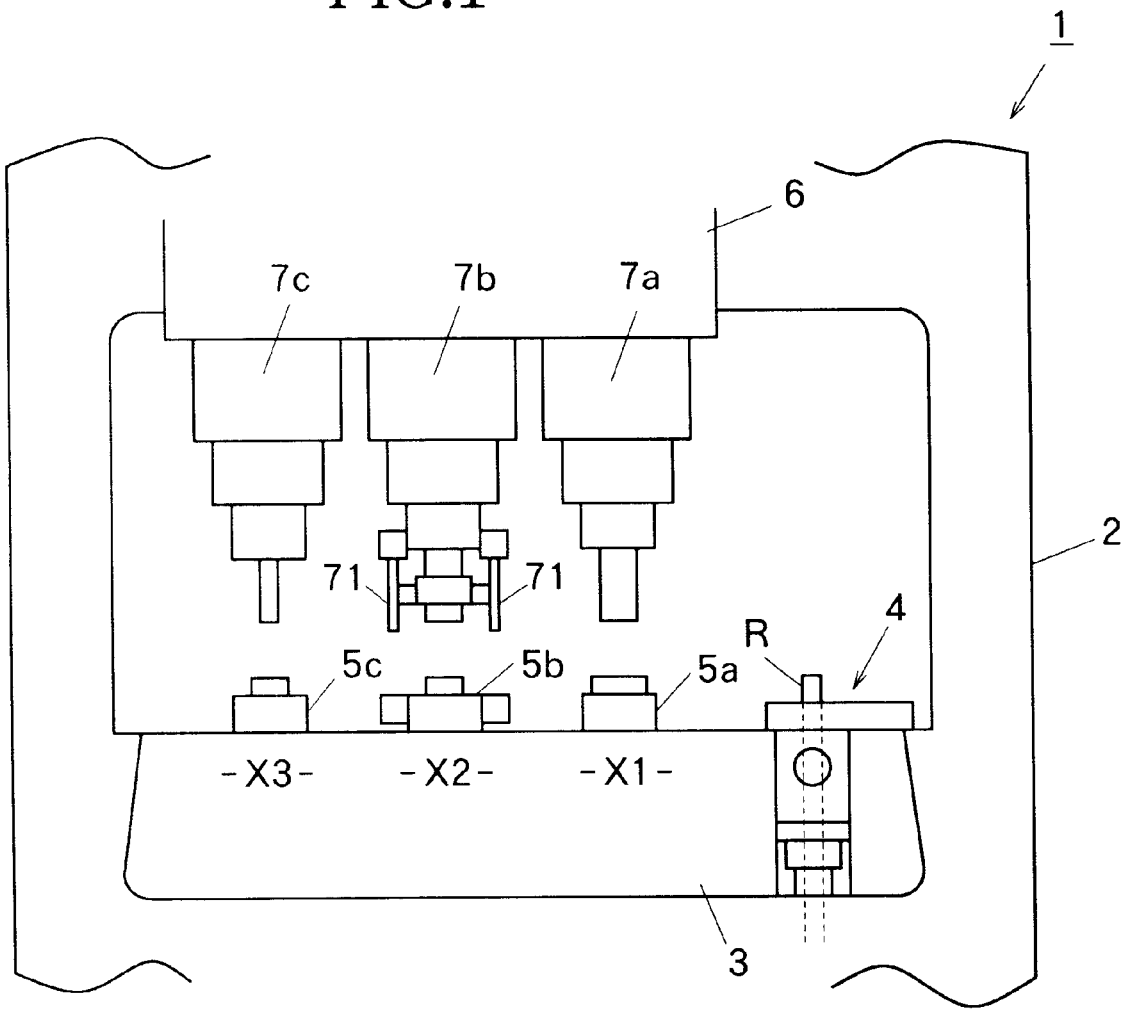
FIG. 1 is a schematic plan view of a multi-stage forging apparatus according to an embodiment of the present invention.

The present embodiment is an application of the full-enclosed die forging apparatus of the present invention to a multi-stage forging apparatus having a plurality of forging stations. As shown in FIG. 1, in a multi-stage forging apparatus 1, provided are a stationary frame 3 fixed at a base 2 and including a cutting unit 4 and first to third stationary die units 5*a*, 5*b* and 5*c*, and a ram 6 moving toward and away from the stationary frame 3 to which first to third movable die units 7*a*, 7*b* and 7*c* are attached facing to their corresponding stationary die units, so that three-stage forging stations X1, X2 and X3 are formed respectively by the corresponding stationary die units and movable die units.

Figure 2:
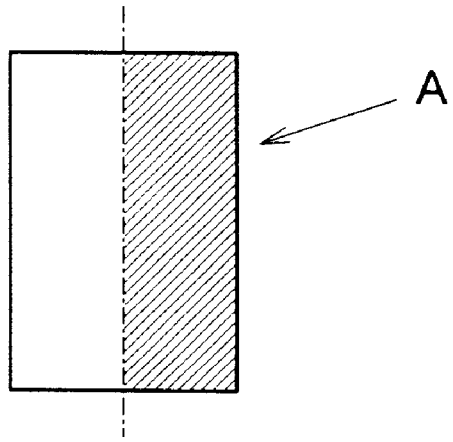
FIGS. 2 to 4 are views showing successive transformation of a workpiece forged by the apparatus of the present invention.

Of the stations, the first forging station X1 corrects end surfaces of a material obtained by cutting a wire rod "R" by the cutting unit 4 to form a cylindrical material A of a desired size as shown in FIG. 2.

Figure 3:
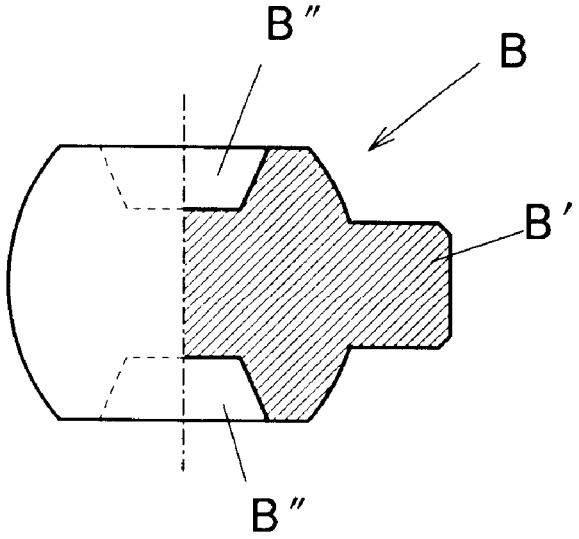

The second forging station X2 conducts full-enclosed die forging with respect to the above-described cylindrical material A to manufacture an intermediate workpiece B having a plurality (only one is shown) of arms B' . . . B' which are provided on its periphery to project in the direction of the radius and concavities B", B" on the opposite ends thereof as shown in FIG. 3. Here, the stationary die unit 5*b* and the movable die unit 7*b* of the second forging station X2 constitute the full-enclosed die forging apparatus of the present invention.

Figure 4:
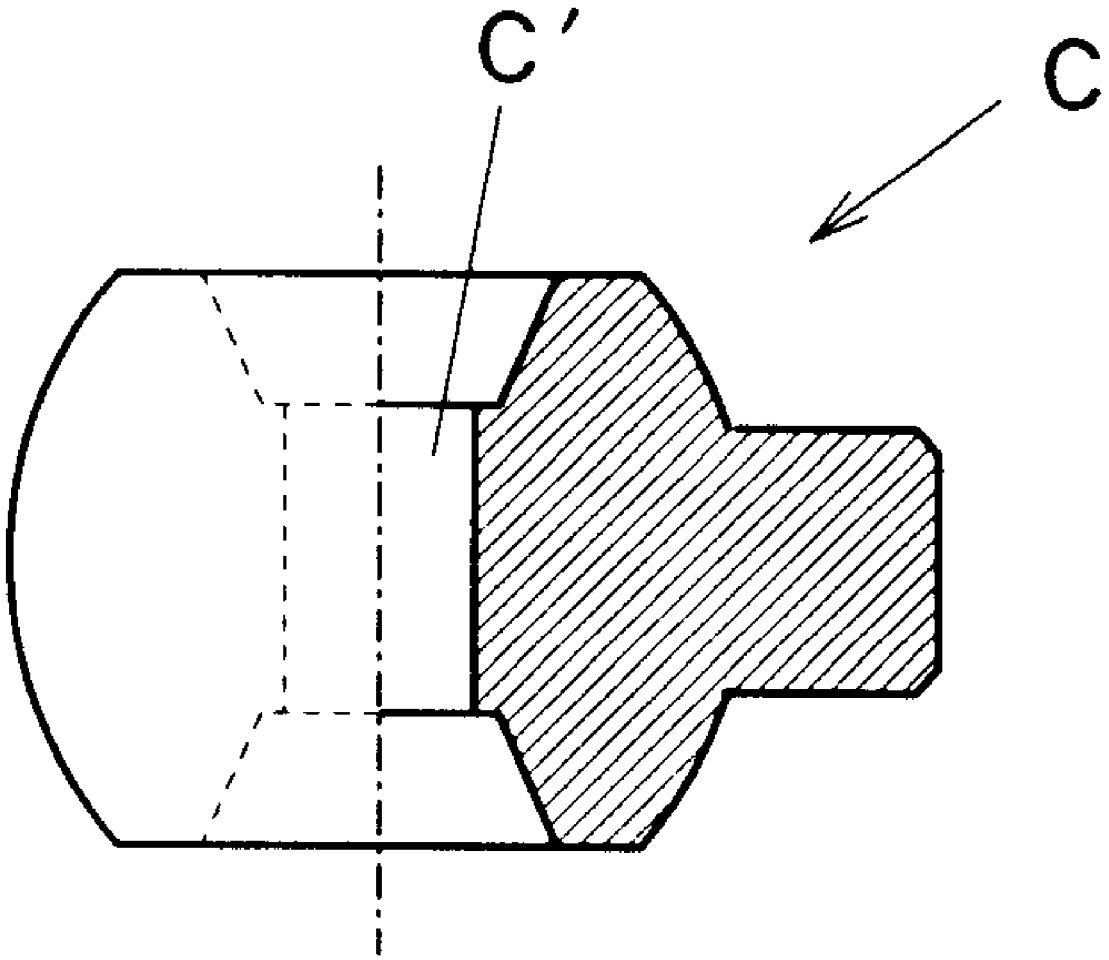

The third forging station X3 pierces a part between the concavities B", B" of the intermediate workpiece B manufactured by the above-described second forging station X2 to form a finished workpiece C having a through hole C' at the center as shown in FIG. 4.

Structure of the stationary die unit 5*b* and the movable die unit 7*b* constituting the above-described second forging station X2 will be next described.

Figure 5:
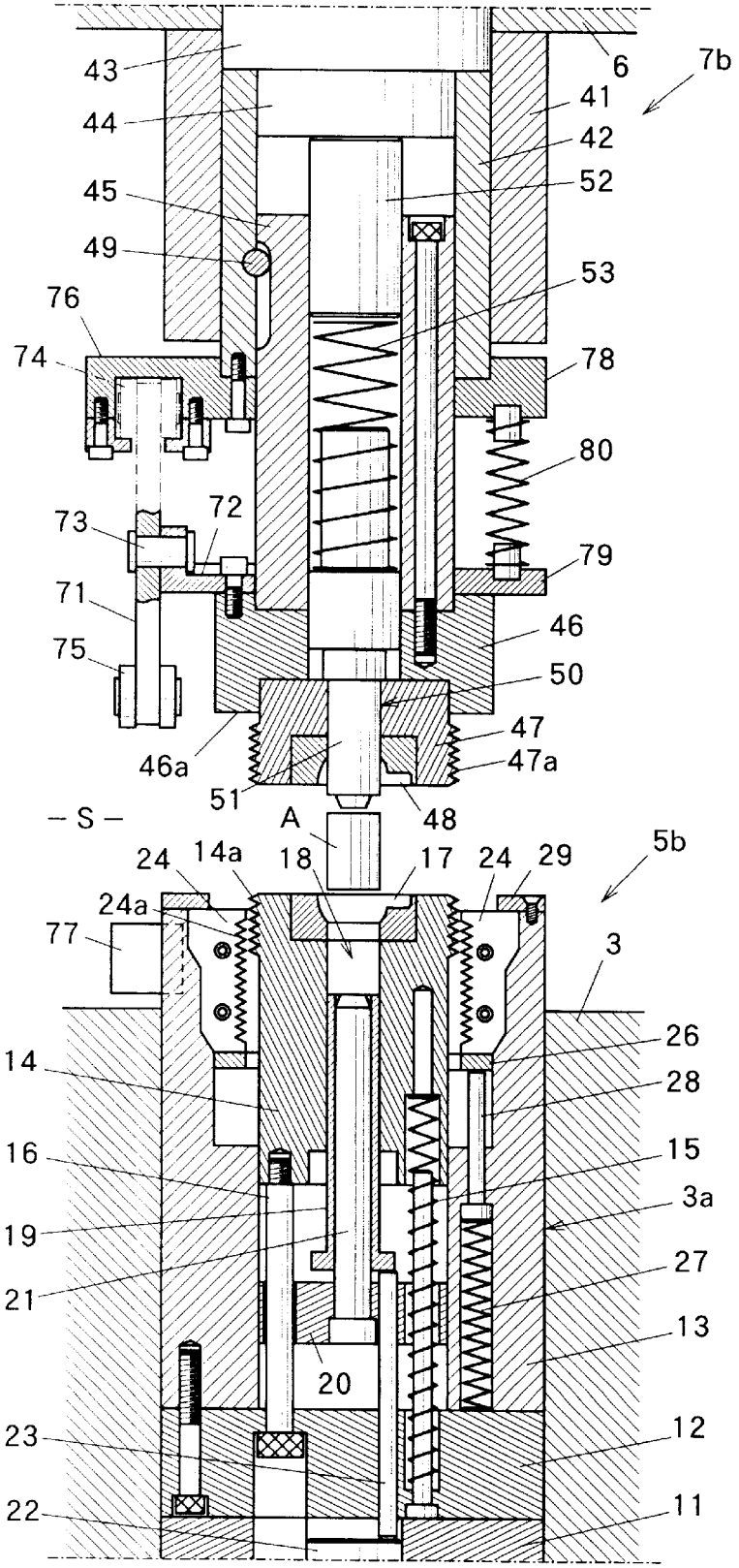
FIG. 5 is a cross-sectional view showing a structure of a full-enclosed die forging apparatus constituting a second forging station of the apparatus of the present invention.

As shown in FIG. 5, the stationary die unit 5*b* includes a substantially cylinder-shaped die housing 13 fixedly inserted in an attachment hole 3*a* provided in the stationary frame 3 through first and second pressure receiving members 11 and 12, a die holder 14 being inserted slidably in the forging direction at the center of die housing 13, a spring 15 which forces the die holder 14 forward (toward a direction of the movable die unit 7*b*), and a stopper bolt 16 for stopping the forward movement caused by the forcing at a position shown in the figure.

Then, at the front end of the die holder 14, a stationary die 17 is attached which has a forging concavity equivalent to a shape obtained by dividing the above intermediate workpiece B in half.

At the center of the die holder 14 and the stationary die 17, a through hole 18 is provided passing through them, in which hole 18 an eject sleeve 19 is inserted slidably in the forging direction. In the eject sleeve 19, a stationary punch 21 is inserted whose rear end is fixed to a retainer 20 and supported slidably in the forging direction. The eject sleeve 19 is designed to be pushed forward by a knockout pin 22 and a knockout rod 23 because of the operation of the knockout mechanism (not shown) when the workpiece is ejected.

Figure 6:
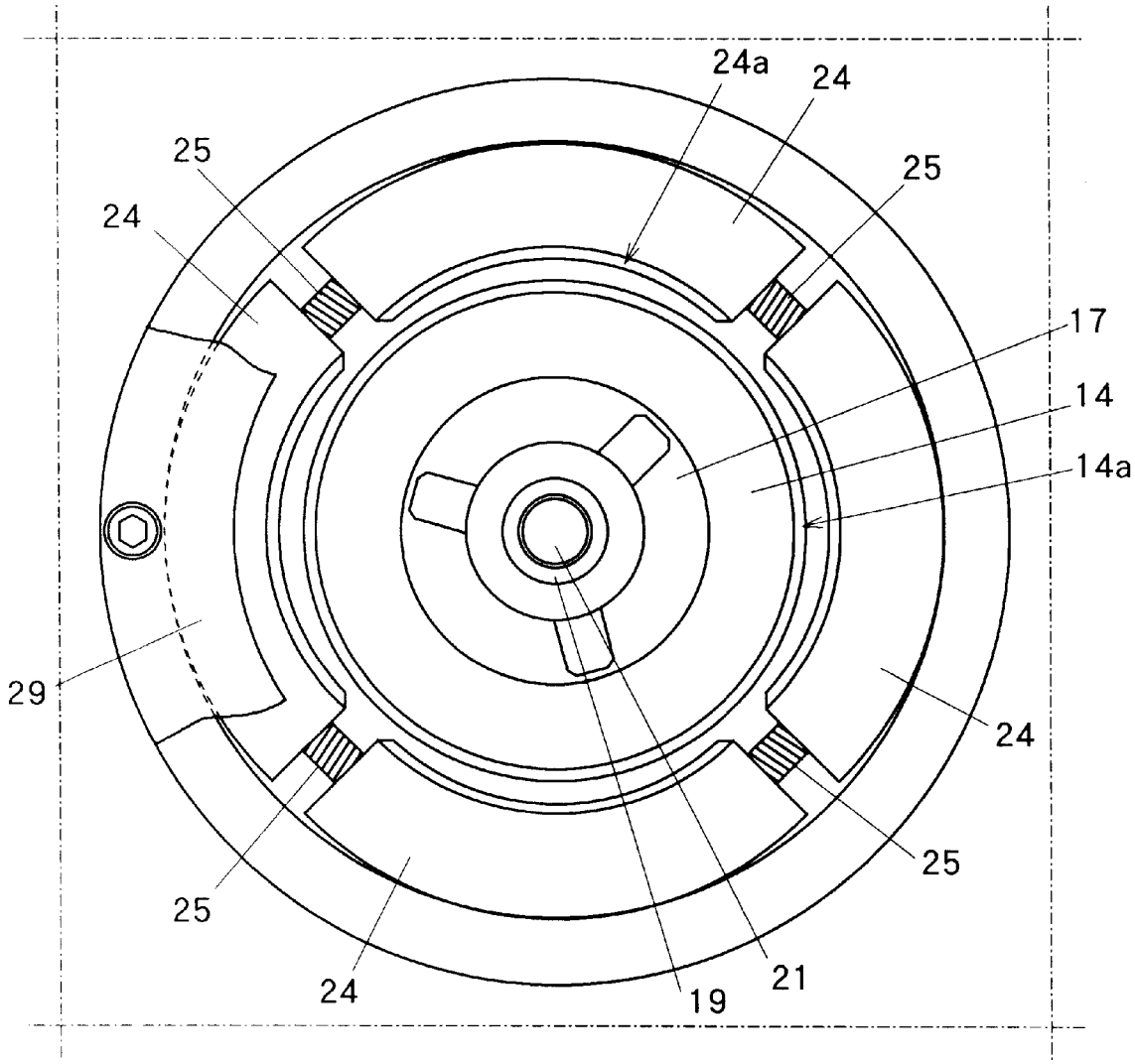
FIG. 6 is a front view of a stationary die unit of the second forging station.

Furthermore, an outer surface of the front end portion of the die holder 14 is formed to be a concavo-convex face 14*a* made up of a plurality of peripheral grooves, and between the outer surface of the die holder 14 and an inner surface of a front end portion of the die housing 13, a plurality of die engaging members 24 . . . 24 are fit. As shown in FIG. 6, each of the engaging members 24 . . . 24 is shaped to be one of four pieces obtained by dividing a tubular member by 90°. The inner surface of each of the engaging members 24 . . . 24 is formed to be a concavo-convex face 24*a* which engages with the concavo-convex face 14*a* on the outer surface of the front end portion of the die holder 14 when these members are made in contact to each other to form a cylinder.

Figure 7:
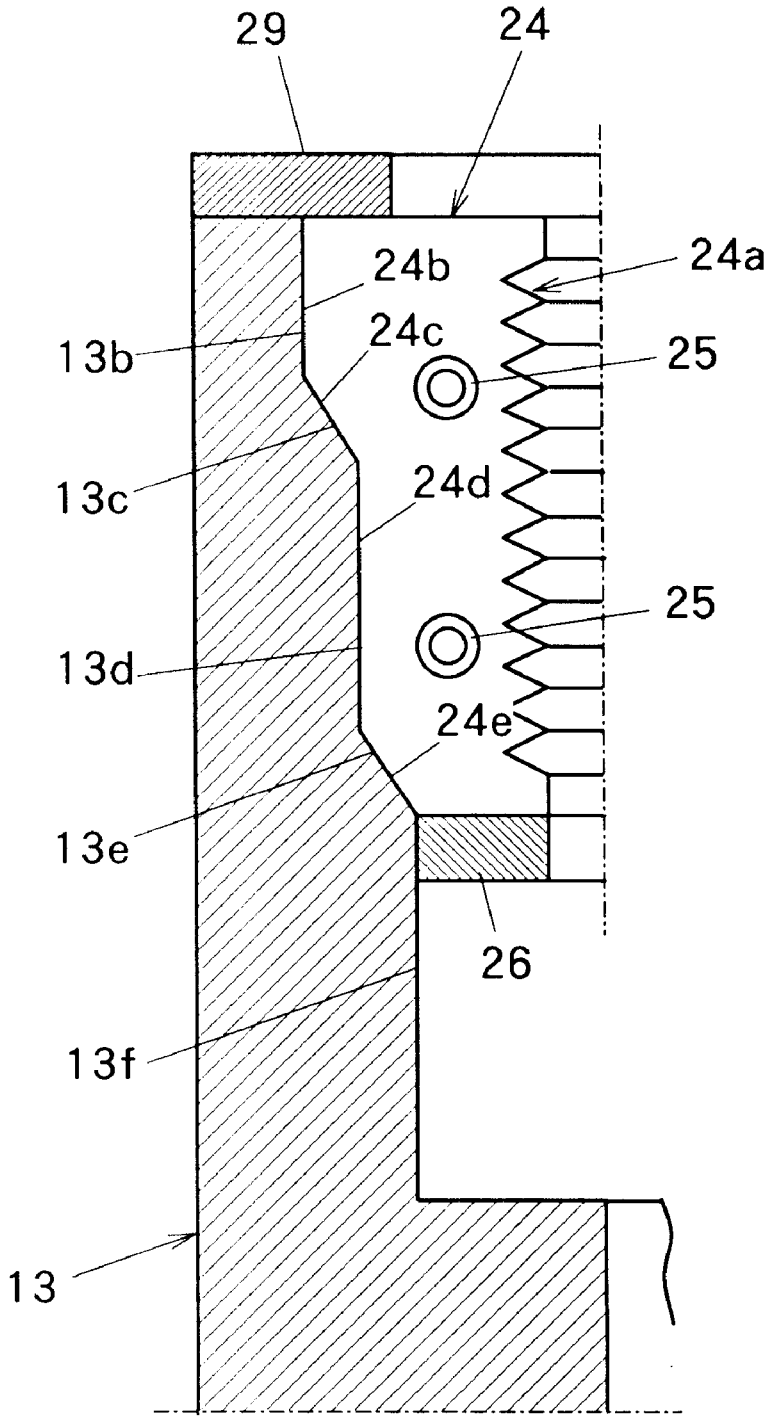
FIG. 7 is an enlarged cross-sectional view of a die engaging member of the second forging station.

Also as shown in FIG. 7, the outer surface of each of the members 24 . . . 24 is formed as a stepped surface having, from the side of the front end, a first cylindrical face 24*b* with a large diameter, a first tapered face 24*c*, a second cylindrical face 24*d* with a small diameter and a second tapered face 24*e*. Correspondingly, the inner surface of the front end portion of the die housing 13 in which these engaging members 24 . . . 24 are fit is also formed as a stepped surface having, from the side of the front end, a first cylindrical face 13*b* with a large diameter, a first tapered face 13*c*, a second cylindrical face 13*d* with a small diameter, a second tapered face 13*e* and a third cylindrical face 13*f* having a diameter smaller than that of the above second cylindrical face 13*d* such that the engaging member becomes smaller in diameter to the bottom thereof.

As shown in FIG. 6, the adjacent members 24 . . . 24 are connected to each other by means of springs 25 . . . 25 to form an annular quaternion. Then, the springs 25 . . . 25 force the four members 24 . . . 24 so as to increase a diameter of the annular quaternion. Then, as shown FIGS. 5 and 7, with the diameter of the annular quaternion increased, the above first cylindrical face 24*b*, the first tapered face 24*c*, the second cylindrical face 24*d*, and the second tapered face 24*e* of the engaging member 24 come into contact with the first cylindrical face 13*b*, the first tapered face 13*c*, the second cylindrical face 13*d* and the second tapered face 13*e* of the die housing 13, respectively. When each engaging member 24 at the state shown in FIG. 5 is forced into the die housing 13, each member is guided along the contact faces between the first tapered faces 24*c* and 13*c* and between the second tapered faces 24*e* and 13*e* so as to decrease in diameter as a whole.

The rear end portion of the engaging members 24 . . . 24 is supported by a ring member 26 slidably fit in the third cylindrical face 13*f* of the die housing 13. Also as shown in FIG. 5, a rear face of the ring member 26 is in contact with a front end portion of each of a plurality of push pins 28 . . . 28 (of which only one is shown in the figure) forced forward by means of springs 27 . . . 27 attached between the ring member 26 and the second pressure receiving member 12, whereby the engaging members 24 . . . 24 are forced forward by means of the springs 27 . . . 27 through the pins 28 . . . 28 and the ring member 26. Then, the forward movement is stopped at a position shown in the figure by a stopper plate 29 provided on the front end face of the die housing 13.

Next, the structure of the movable die unit 7*b* will be described. As shown in FIG. 5, fixed to the ram 6 are an outer holder 41 and an inner holder 42 fit therein, and disposed inside the holders 41 and 42 are first and second pressure receiving members 43 and 44 for receiving a front load (stationary frame 3 side).

Furthermore, inside the inner holder 42, slidably inserted in the forging direction is a slidable sleeve 45 at the front end of which a die holder 47 is disposed with a die attachment member 46 provided therebetween. On the front end of the die holder 47, a movable die 48 is held having a molding concavity equivalent to a shape obtaining by dividing the above intermediate workpiece B in half. An outer peripheral face of the die holder 47 is formed to a concavo-convex face 47*a* similar to the concavo-convex face 14*a* of the outer surface of the front end of the die holder 14 in the stationary die unit 5*b*.

A front end surface 46*a* of the die attachment member 46 faces to the front end surface of the engaging members 24 . . . 24 in the stationary die unit 5*b*, and when the movable die unit 7*b* and the slidable sleeve 45 move forward by a predetermined length, the front end surface 46*a* of the die attachment member 46 comes into contact with the front end surface of the engaging members 24 . . . 24 to thrust the engaging members 24 . . . 24 into the die housing 13.

Here, the slidable sleeve 45 has its range of slide with respect to the inner holder 42 restricted and its rotation stopped by a stop pin 49.

A through hole 50 is provided at the center of the die holder 47 and the movable die 48 to pass through them, and into the through hole 50, a front portion of a movable punch 51 is slidably inserted in the forging direction. Arranged at the back of the movable punch 51 is a subsidiary punch 52 slidably inserted into the slidable sleeve 45. The movable punch 51 is forced forward by means of a spring 53 installed between the punches 51 and 52 up to a position where the tip of the punch 51 projects from the movable die 48 by a predetermined length.

Figure 8:
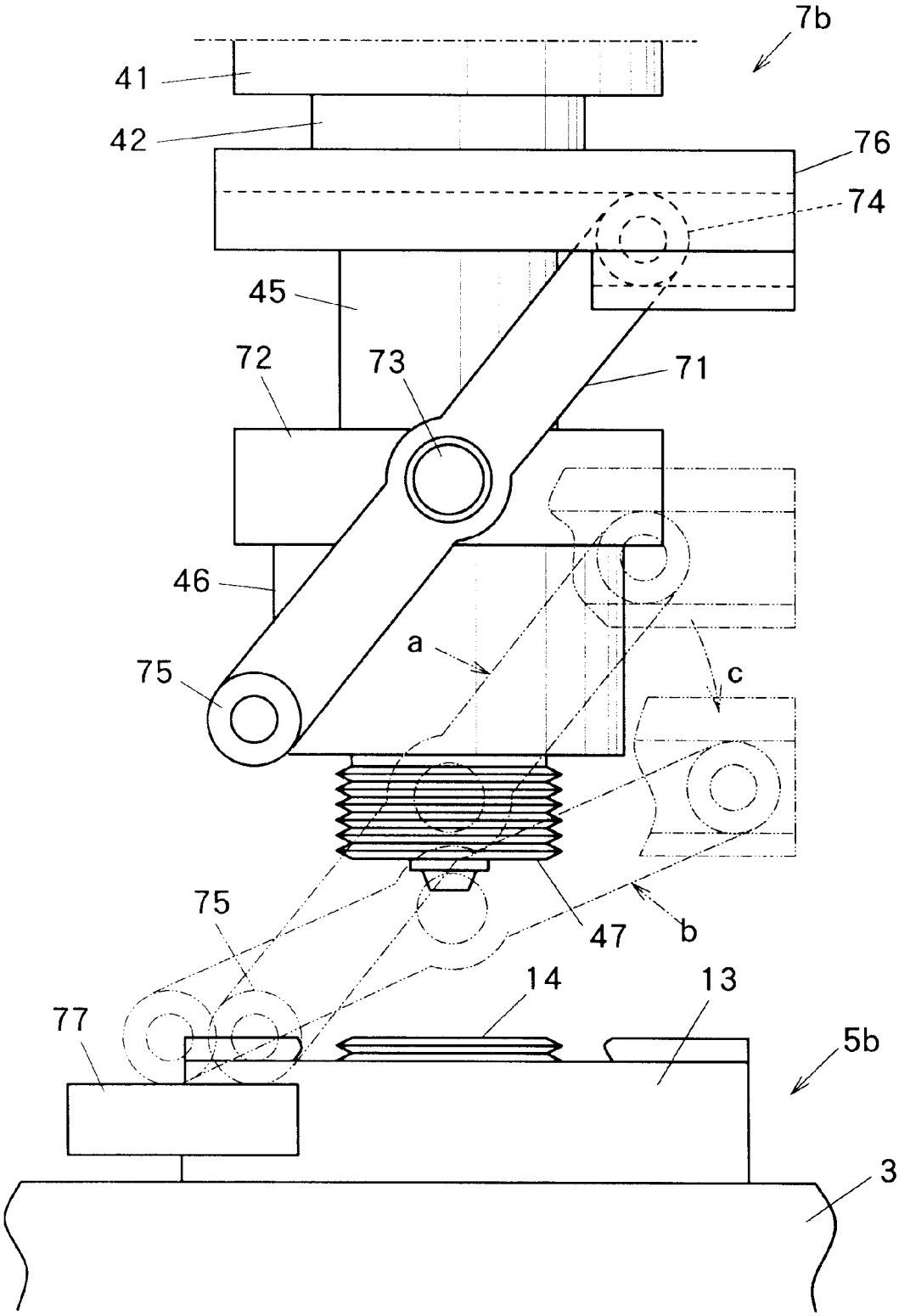
FIG. 8 is a side view of a differential mechanism of the apparatus of the present invention.

In addition to the above components, the movable die unit 7*b* includes a link member 71 for differential operation of dies. As shown in FIGS. 5 and 8, the link member 71 has its center portion ratatably held at a bracket 72 fixed to the die attachment member 46 by a pin 73 and its opposite ends provided with rollers 74 and 75. The roller 74 on the ram 6 side is engaged with a guide member 76 mounted to the inner holder 42 and extending in a direction perpendicular to the forging direction of the movable die unit 7*b*, so that the link member 71 is held to have an inclination as a whole.

On the other hand, the roller 75 on the stationary frame 3 side is free at an ordinary state and when the movable die unit 7*b* and the slidable sleeve 45 move forward by a predetermined length, it comes into contact with a receiving member 77 fixed to the stationary die unit 5*b*, and at that state, when the movable die unit 7*b* and the like move forward further, the link member 71 rotates with the roller 75 as a fulcrum from the inclining position "a" to the lying position "b" in the direction indicated by the arrow "c" as shown in FIG. 8.

As shown in FIG. 5, the apparatus 1 further includes a spring 80 provided between a spring receiving member 78 mounted to the inner holder 42 and another spring receiving member 79 mounted to the slidable sleeve 45 for forcing the link member 71 to the inclining position shown in FIG. 8.

Description will be next made of operation of the above described multi-stage forging apparatus 1, particularly, of the second forging station X2 for conducting full-enclosed die forging.

As shown in FIG. 5, when the cylindrical material A is transferred to the second forging station X2 from the first forging station X1 by an automatic transfer device not shown, the movable die unit 7*b* moves forward together with the ram 6, whereby the movable punch 51 of the movable die unit 7*b* drives the material A into the die 17 of the stationary die unit 5*b* and into the hole 18 at the center of the die holder 14 to hold the material A between the front end of the punch 51 and the front end of the stationary punch 21 in the hole 18.

Figure 9:
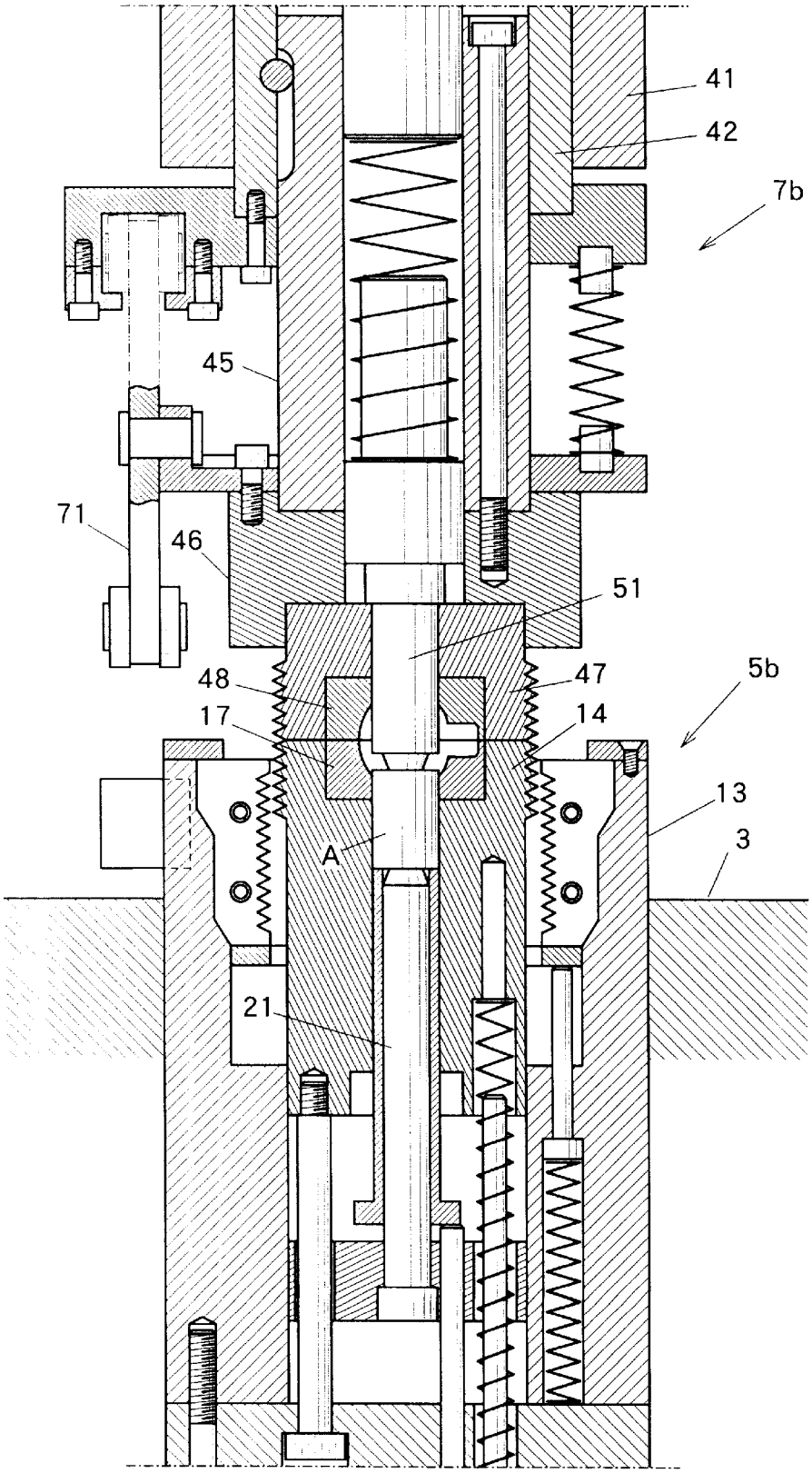
FIGS. 9 to 12 are cross-sectional views showing forging operation of the second forging station step by step.

Then, as shown in FIG. 9, the front faces of the die holder 47 and the movable die 48 held by the die holder 47 in the movable die unit 7*b* come into contact with the front faces of the die holder 14 and the stationary die 17 held by the holder 14 in the stationary die unit 5*b* to form a cavity of a predetermined shape by the closed pair of dies 17 and 48.

Figure 10:
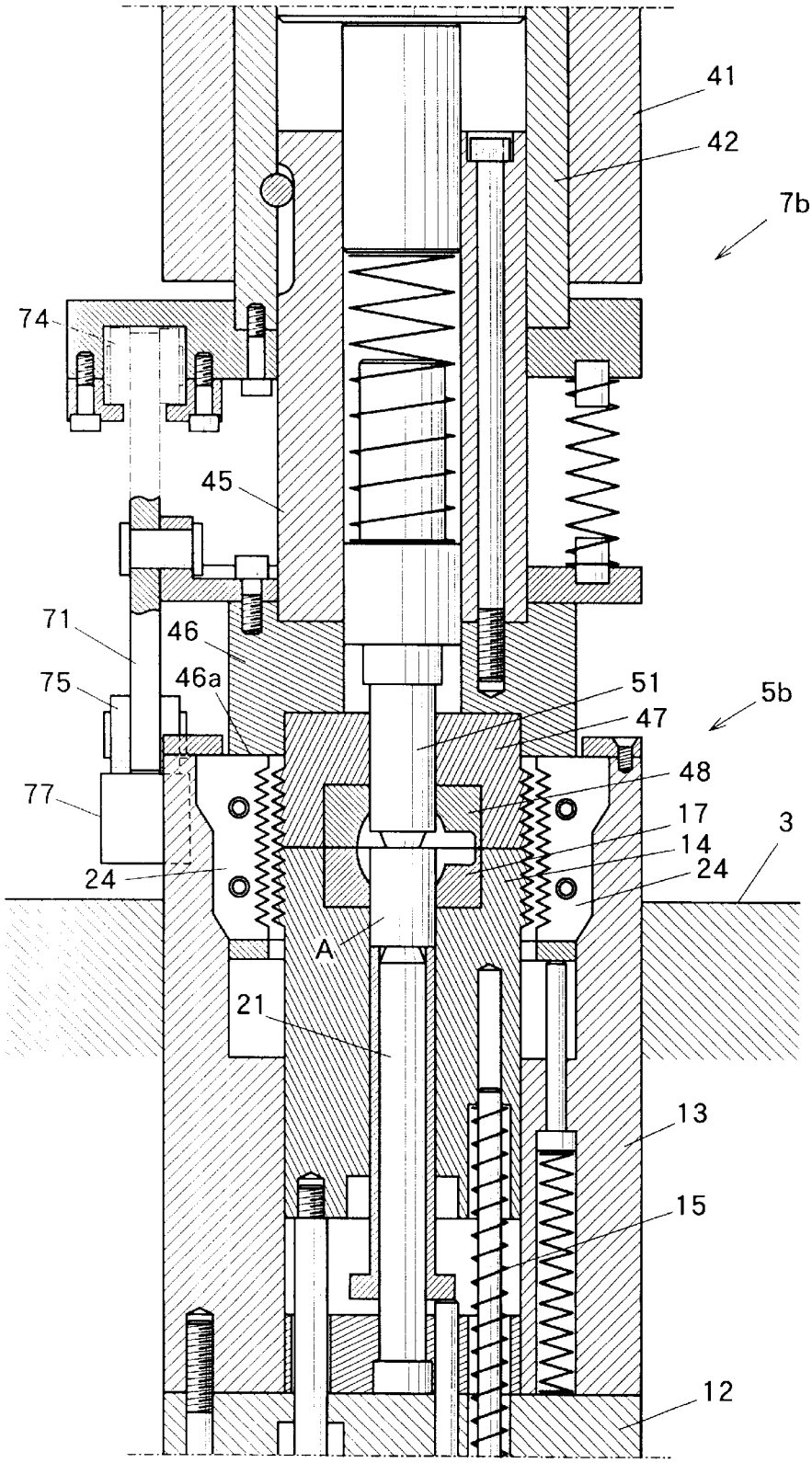

At this state, when the ram 6 moves forward further, as shown in FIG. 10, the closed pair of dies 17 and 48 whose front end surfaces are in contact with each other are thrust into the die housing 13 on the stationary die unit 5*b* against the biasing force of the spring 15 and when the closed pair of dies 17 and 48 are thrust by a predetermined length, the front face 46*a* of the die attachment member 46 in the movable die unit 7*b* comes into contact with the front faces of the four die engaging members 24 . . . 24 housed in the die housing 13.

Also at this time, the rear end of the stationary punch 21 comes into contact with the second pressure receiving member 12 to prevent the movable punch 51 from moving forward through the stationary punch 21 and the material A. Furthermore, the roller 75 of the link member 71 on the side of the stationary frame 3 comes into contact with the receiving member 77 provided in the die housing 13.

Figure 11:
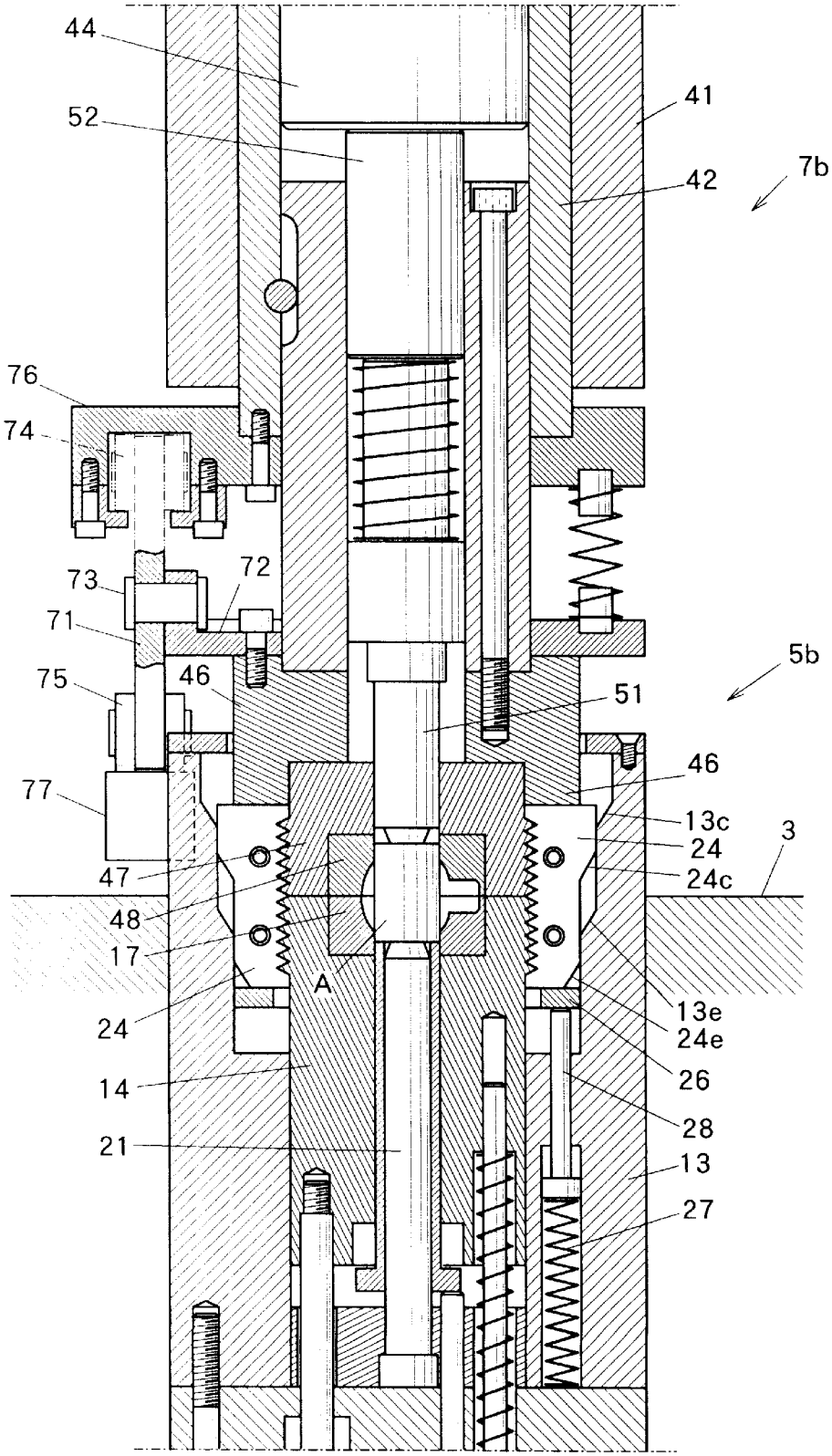

Then, at this state, when the ram 6 moves forward further, as shown in FIG. 11, the die attachment member 46 thrusts the die engaging members 24 . . . 24 backward into the die housing 13 against the biasing force of the spring 27. On this occasion, these engaging members 24 . . . 24 have their first and the second tapered faces 24*c* and 24*e* of the outer surface guided by the first and the second tapered faces 13*c* and 13*e* of the inner surface of the die housing 13 to decrease in diameter as a whole against the biasing force of the springs 25 . . . 25 shown in FIG. 6.

As a result, the concavo-convex faces 24*a* . . . 24*a* formed on the inner surfaces of the members 24 . . . 24 engage with the concavo-convex faces 14*a* and 47*a* on the outer surfaces of the die holders 14 and 47 on the stationary and movable sides to mechanically join the pair of die holders 14 and 47, thereby reliably maintaining the cavity formed by the pair of the die holders 14 and 47 at a closed state.

While the pair of closed die holders 14 and 47 are thrust backward into the die housing 13 as shown in FIGS. 10 and 11, the movement of the punches 21 and 51 is prevented, so that the material A held between the punches 21 and 51 will be relatively introduced into the center of the cavity from the hole 18 of the die holder 14. Upon positioning of the material A at the center of the cavity as shown in the figure, the subsidiary punch 52 of the movable die unit 7*b* comes into contact with the rear end of the movable punch 51, whereby the movable punch 51 moves forward integrally with the ram 6.

Furthermore, since the roller 75 of the link member 71 on the side of the stationary frame 3 is in contact with the receiving member 77 at the states shown in FIGS. 10 and 11 as described above, the link member 71 has its one end restrained by the guide member 76 fixed to the inner holder 42 which moves integrally with the ram 6 and the other end restrained by the receiving member 77 fixed to the die housing 13 of the stationary frame 3.

As a result, the link member 71 rotates from the inclining position indicated by a chain line "a" to the lying position indicated by a chain line "b" in the direction indicated by the arrow "c" shown in FIG. 8 because the guide member 76 and the receiving member 77 come closer to each other as the ram 6 moves forward. At this time, the position of the pin 73 at the center of the link member 71, that is, the die attachment member 46 supporting the pin 73 through the bracket 72, moves toward the stationary frame 3 side at a speed of the guide member 76 moving toward the receiving member 77, that is, at half the advancement speed of the ram 6.

As a result, the pair of dies 17 and 48 moving integrally with the die attachment member 46 is thrust into the die housing 13 at half the advancement speed of the movable punch 51 moving integrally with the ram 6.

Figure 12:
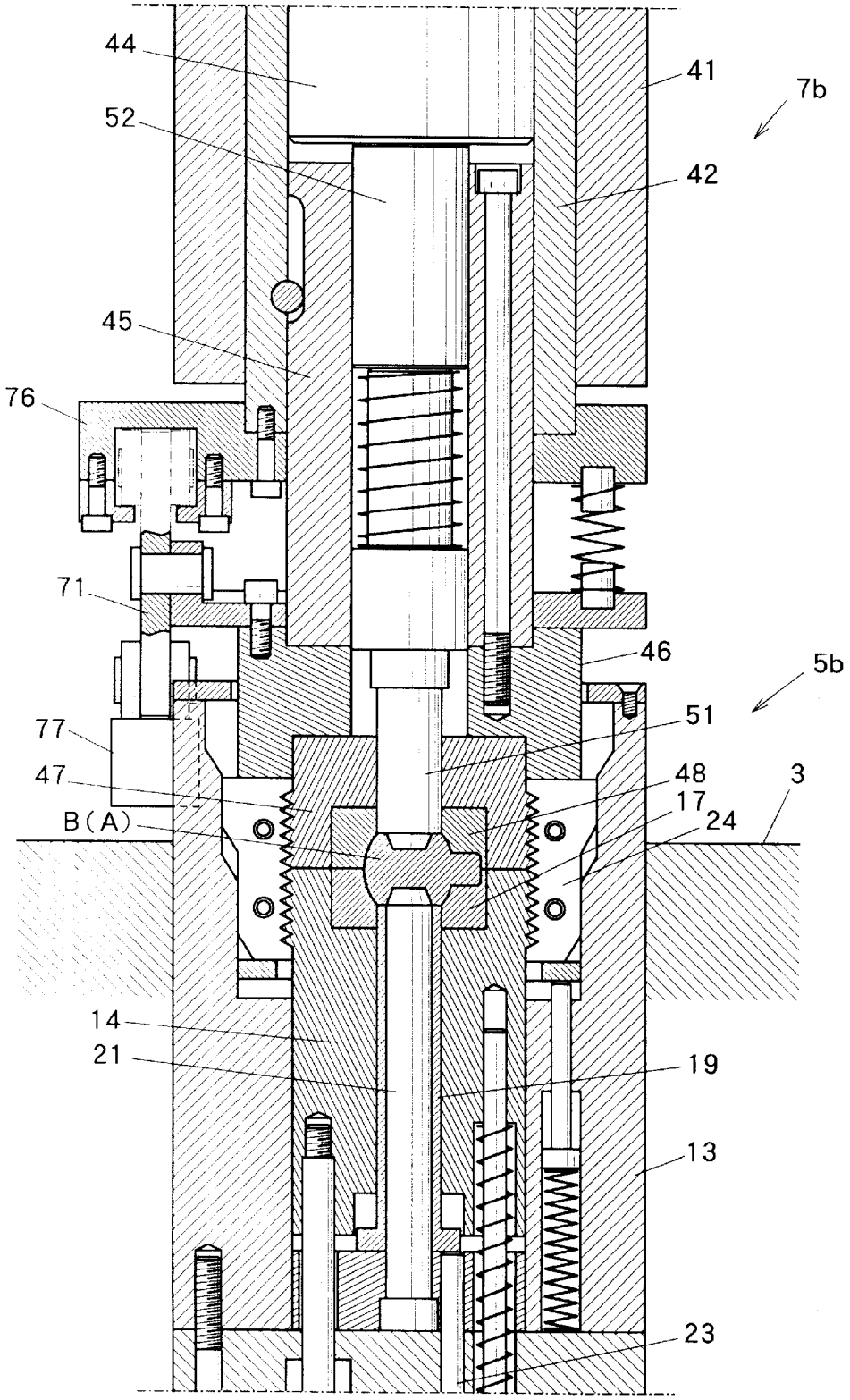

Accordingly, as shown in FIG. 12, the material A in the cavity is pressed equally from the opposite ends thereof by the stationary punch 21 and the movable punch 51, so that a concavity is formed on each end of the material. Especially in such a case as this where a workpiece having a plurality of arms radially projecting is to be formed, when the amount of flow of the material is large, the workpiece can be molded satisfactorily as well.

In a manner as described above, the intermediate workpiece B having the concavities B", B" on its opposite ends and a plurality of arms B' . . . B' projecting radially provided on its peripheral face is formed as shown in FIG. 3. Thereafter, the ram 6 moves backward and the pair of dies 17 and 48 move toward the ram 6 side and in the meantime, the plurality of the engaging members 24 . . . 24 expand to release the joining of the pair of dies 17 and 48. Then, the ram 6 moves backward further, so that the movable die 48 moves away from the stationary die 17 and the KO pin 22 starts operating, whereby the intermediate workpiece B is taken out from the stationary die 17 through the KO rod 23 and the eject sleeve 19.

Then, the intermediate workpiece B is transferred to the third forging station X3 where the finished workpiece C is formed by piercing the concavities B",B" on the opposite ends to have the through hole C'.

Thus, such workpieces C as shown in FIG. 4 are formed sequentially and successively. According to the above-described structure, only the forwarding operation of the ram 6 results in having a series of operation, at the second forging station X2, of closing of the stationary die 17 and the movable die 48 and mechanical joining of the pair of dies 17 and 48 by means of the engaging members 24 . . . 24 and of forging of the material A in the cavity equally from the opposite ends thereof by the differential mechanism of the pair of dies 17 and 48 and the movable punch 51.

In addition, because the mechanism for the above differential operation has a simple structure made of the link member 71, and the guide member 76 and the receiving member 77 which restrain the opposite ends thereof and also because the slidable sleeve 45 supporting the link member 71 is fit in between the movable punch 51 and the inner holder 42, it is unlikely that the forging station X2 becomes complicated in structure or large-scaled because of the provision of the differential mechanism.

Thus, the above-described full-enclosed die forging will be conducted satisfactorily in the multi-stage forging apparatus 1 having the plurality of forging stations without affecting working and layout of adjacent stations and without causing the apparatus 1 to be large-scaled.

Then, since the link member 71 is supported by the slidable sleeve 45 in the movable die unit 7*b* to make enough room (S) between the link member 71 and the stationary frame 3 when the ram 6 moves backward as shown in FIG. 5, it is not a hindrance to arrangement and operation of the transfer device provided in the stationary frame 3 for transferring a material sequentially from an upstream station to a downstream station.

Although the forgoing description has been made assuming that the center of the link member 71 for differential operation is linked to the slidable sleeve 45 by the pin 73, thereby making the pair of dies 17 and 48 move at half the advancement speed of the movable punch 51, the moving speed of the pair of dies 17 and 48 may be set at an arbitrary speed lower than the moving speed of the movable punch 51 by varying the length from the point of connection to the slidable sleeve 45 by the pin 73 to the rollers 74 and 75.

Besides, as to the link members 71, although two may be provided on the opposite sides as shown in FIG. 1, one or more than two link members 71 can be provided as needed.

Figure 13:
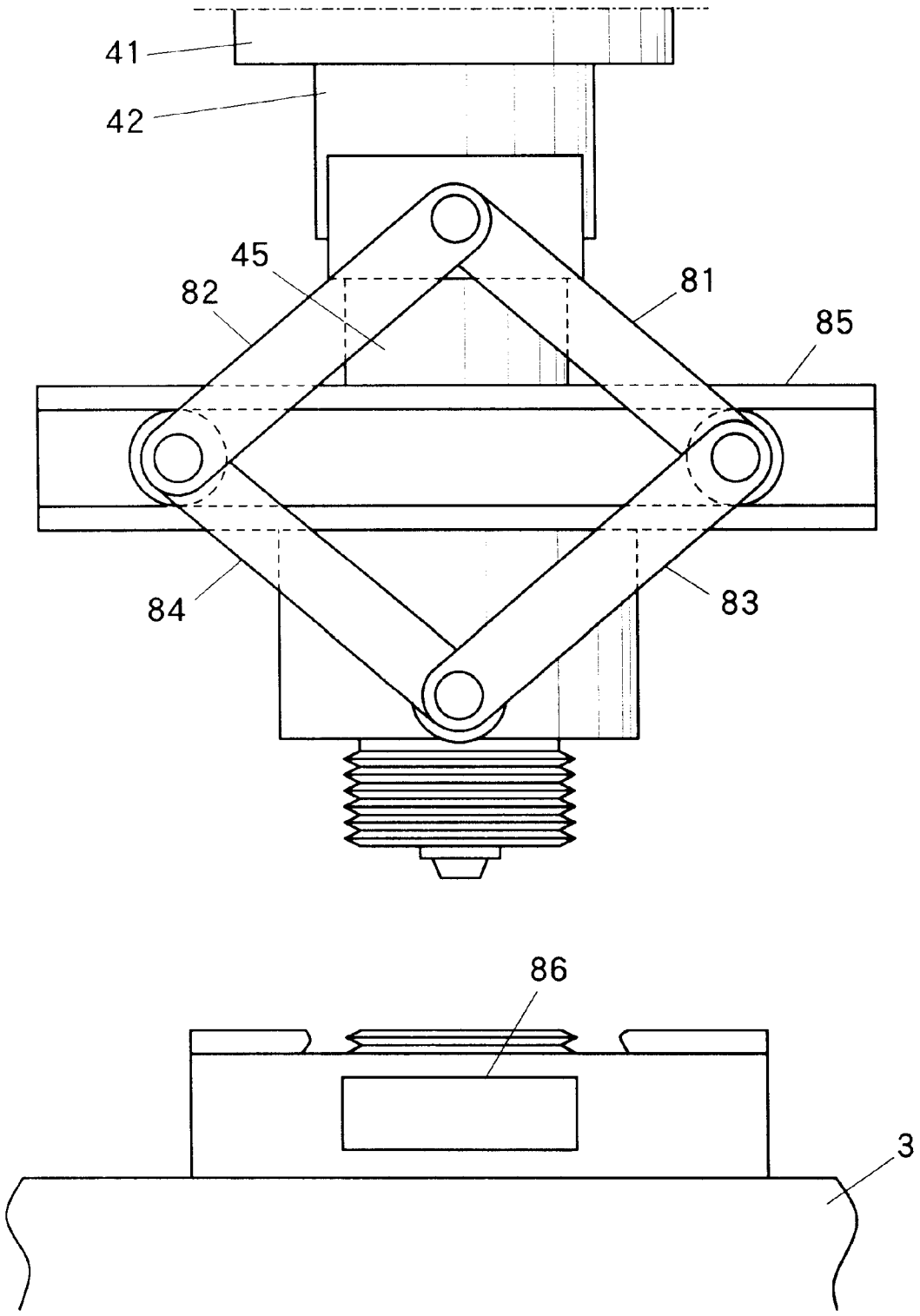
FIG. 13 is a side view of another differential mechanism of the present apparatus.

Furthermore, as shown in FIG.13, a link mechanism having four link members, that is, first to forth link members 81~84 connected to be lozenge-shaped, can be used for a differential mechanism of the apparatus 1.

In this case, by linking connection points of the first and the second link members 81 and 82 to the inner holder 42, as well as engaging connection points of the first and the third link members 81 and 83 and connection points of the second and the fourth link members 82 and 84 with a guide member 85 attached to the slidable sleeve 45 and extending in a direction perpendicular to the axis of 45, after the connection points of the third and the fourth link members 83 and 84 come into contact with a receiving member 86 on the stationary frame 3 side because of forward movement of the ram and the holders 41 and 42, the speed of the pair of dies moving integrally with the slidable sleeve 45 will be lower than the advancement speed of the ram 6.

A full-enclosed die forging apparatus according to another preferred embodiment of the present invention will now be described.

Figure 14:
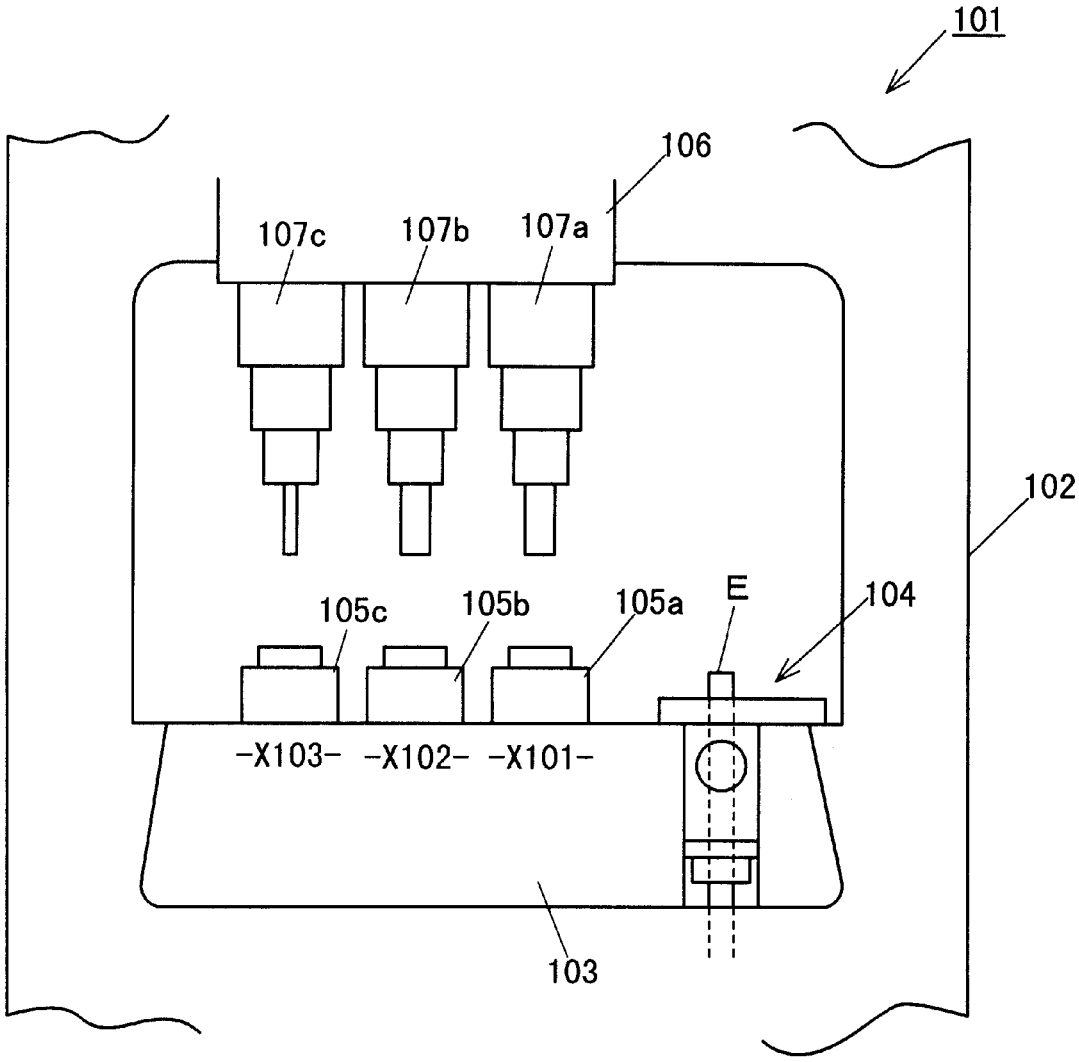
FIG. 14 is a schematic plan view, similarly to FIG. 1, showing a multi-stage forging apparatus according to a second embodiment of the present invention.

The present embodiment is an application of the full-enclosed die forging apparatus of the present invention to a multi-stage forging apparatus having a plurality of forging stations. As shown in FIG.14, in a multi-stage forging apparatus 101, provided are a stationary frame 103 fixed at a base 102 and including a cutting unit 104 and first to third stationary die units 105*a*, 105*b* and 105*c*, and a ram 106 moving toward and away from the stationary frame 103 to which first to third movable die units 107*a*, 107*b* and 107*c* are attached facing to their corresponding stationary die units, so that three-stage forging stations X101, X102 and X103 are formed respectively by the corresponding stationary die units and movable die units.

Figure 15:
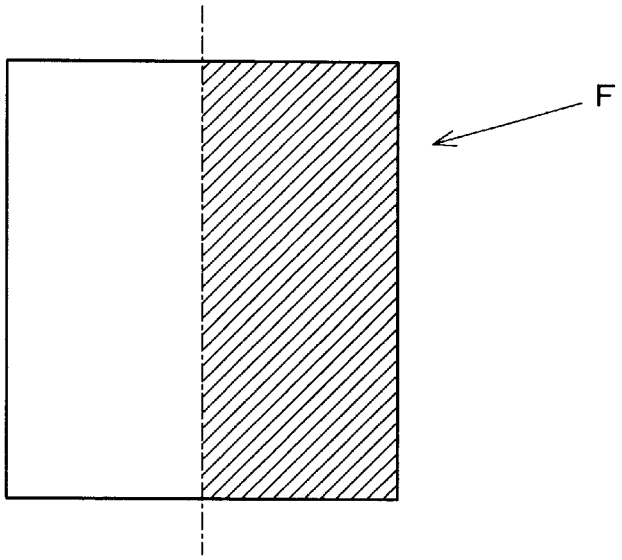
FIGS. 15 to 17 are views, similarly to FIGS. 2 to 4, respectively, showing successive transformation of a workpiece forged by the apparatus of the second embodiment of the present invention.

Of the stations, the first forging station X101 corrects end surfaces of a material obtained by cutting a wire rod "E" by the cutting unit 104 to form a cylindrical material F of a desired size as shown in FIG. 15.

Figure 16:
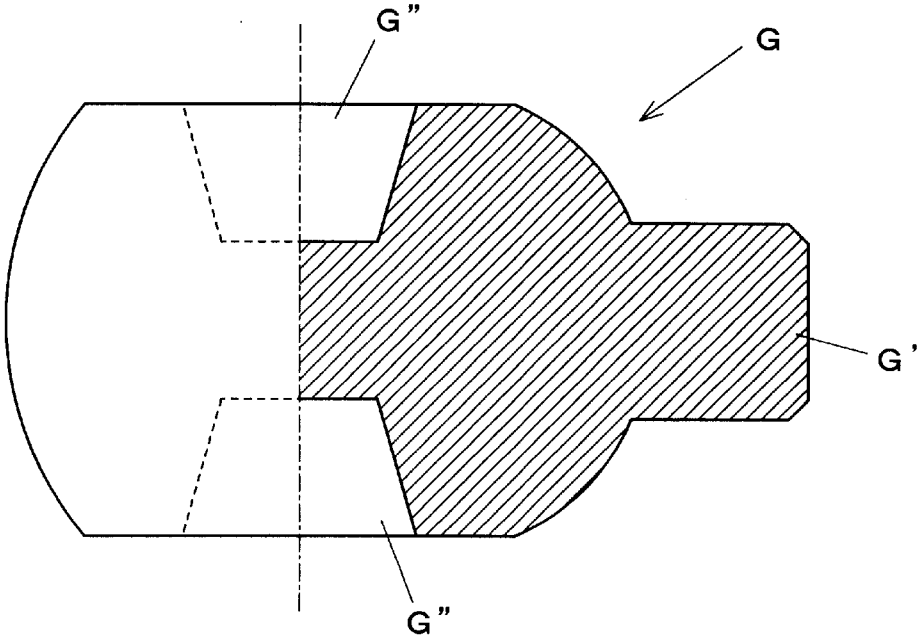

The second forging station X102 conducts full-enclosed die forging with respect to the above-described cylindrical material F to manufacture an intermediate workpiece G having a plurality (only one is shown) of arms G' . . . G' which are provided on its periphery to project in the direction of the radius and concavities G", G" on the opposite ends thereof as shown in FIG. 16. Here, the stationary die unit 105*b* and the movable die unit 107*b* of the second forging station X102 constitute the full-enclosed die forging apparatus of the present invention.

Figure 17:
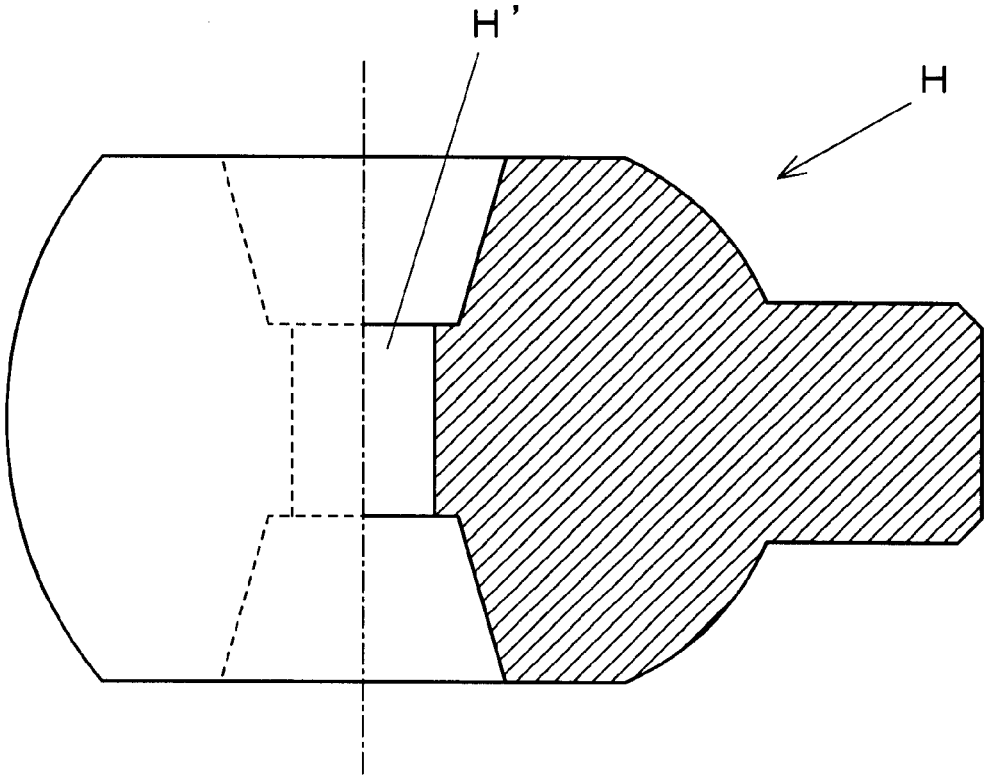

The third forging station X103 pierces a part between the concavities G", G" of the intermediate workpiece G manufactured by the above-described second forging station X102 to form a finished workpiece H having a through hole H' at the center as shown in FIG. 17.

Structure of the stationary die unit 105*b* and the movable die unit 107*b* constituting the above-described second forging station X102 will be next described.

Figure 18:
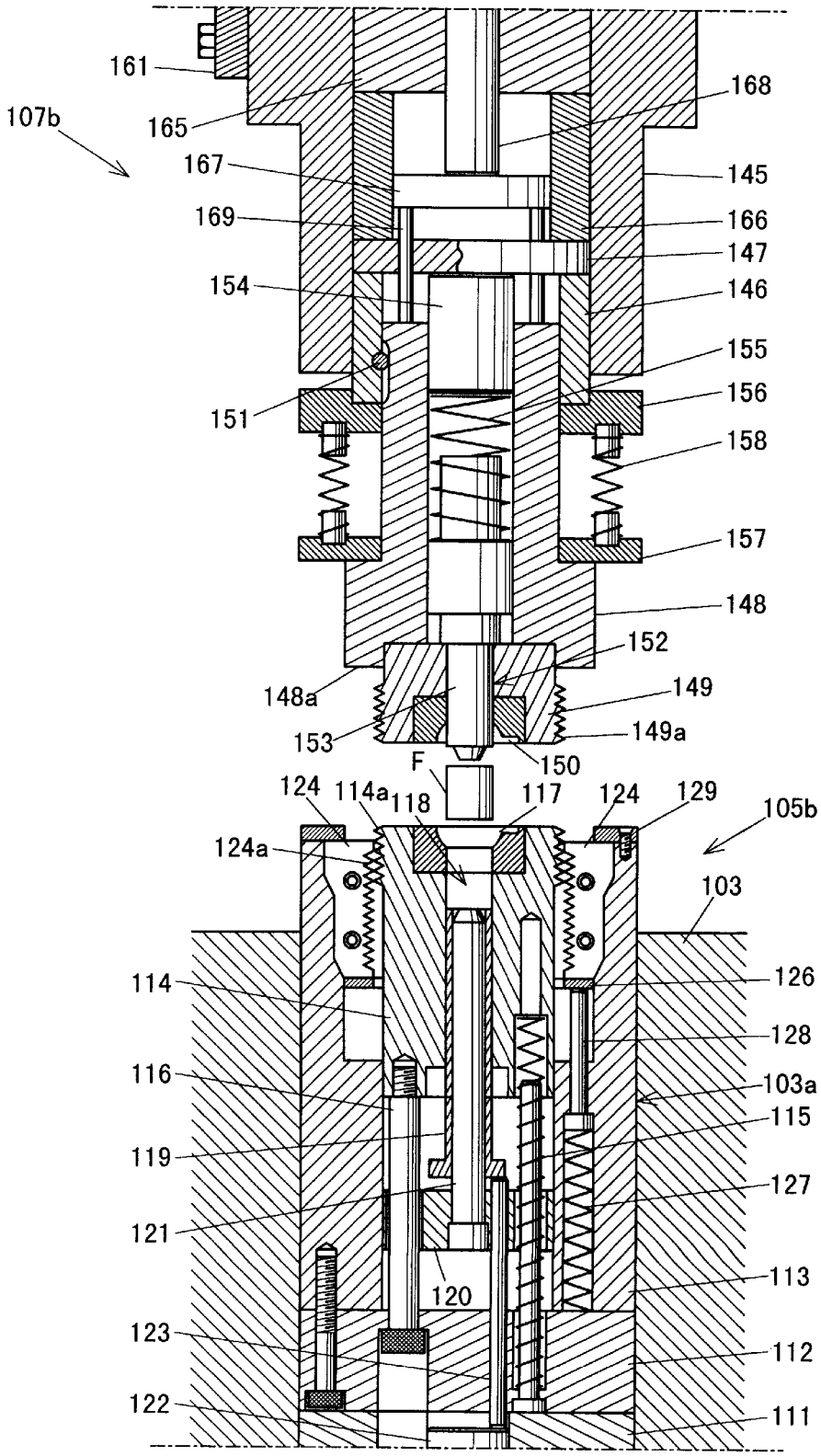
FIG. 18 is a partial cross-sectional view, similarly to FIG. 5, showing a stationary frame side of a full-enclosed die forging apparatus constituting a second forging station of the second embodiment of the present invention.

As shown in FIG. 18, the stationary die unit 105*b* includes a substantially cylinder-shaped die housing 113 fixedly inserted in an attachment hole 103*a* provided in the stationary frame 103 through first and second pressure receiving member 111 and 112, a die holder 114 being inserted slidably in the forging direction at the center of die housing 113, a spring 115 which forces the die holder 114 forward (toward a direction of the movable die unit 107*b*), and a stopper bolt 116 for stopping the forward movement caused by the forcing at a position shown in the figure.

Then, at the front end of the die holder 114, a stationary die 117 is attached which has a forging concavity equivalent to a shape obtained by dividing the above intermediate workpiece G in half.

At the center of the die holder 114 and the stationary die 117, a through hole 118 is provided passing through them, in which hole 118 an eject sleeve 119 is inserted slidably in the forging direction. In the eject sleeve 119, a stationary punch 121 is inserted whose rear end is fixed to a retainer 120 and supported slidably in the forging direction. The eject sleeve 119 is designed to be pushed forward by a knockout pin 122 and a knockout rod 123 because of the operation of the knockout mechanism (not shown) when the workpiece is ejected.

Figure 19:
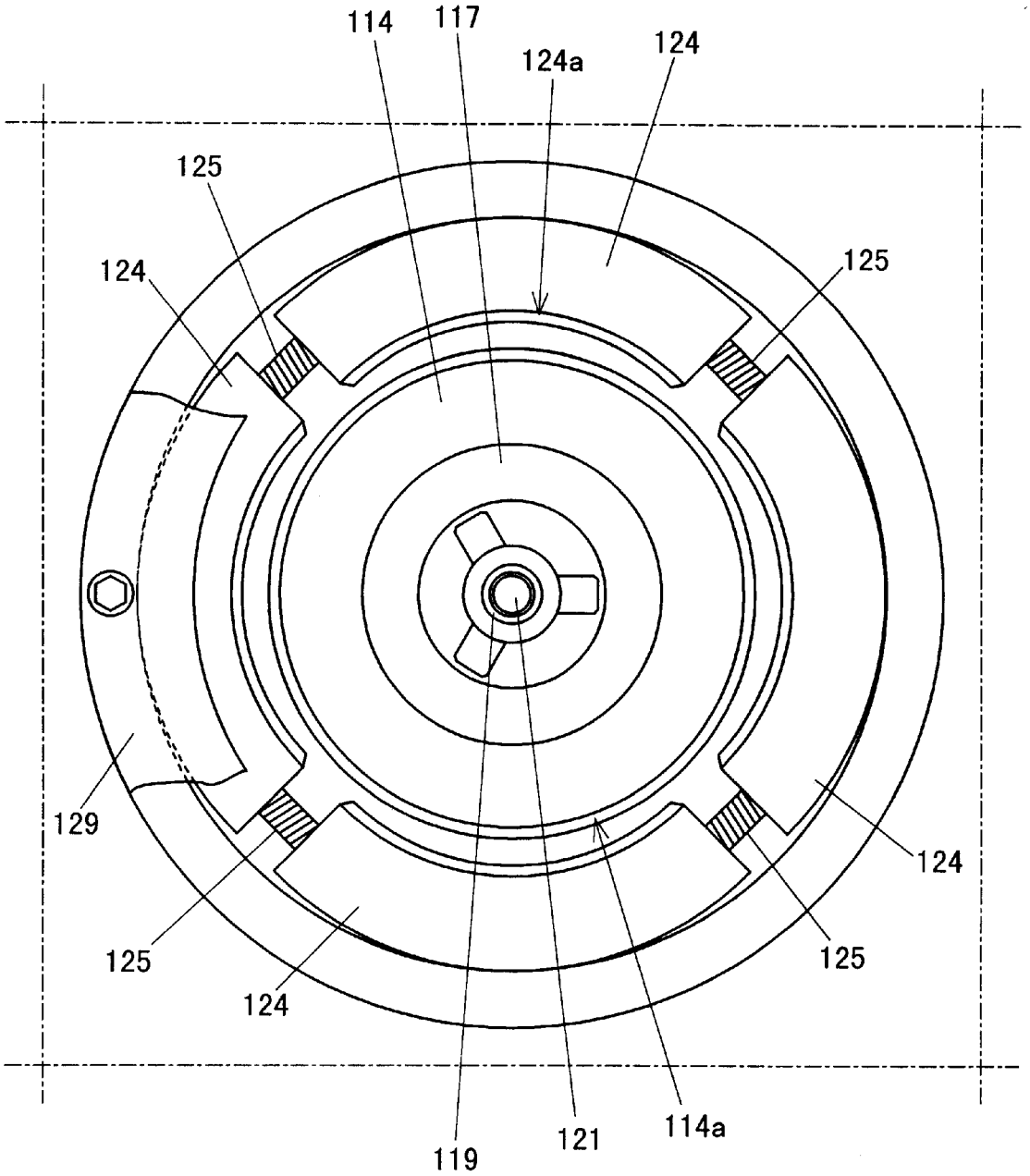
FIG. 19 is a front view, similarly to FIG. 6, showing a stationary die unit of the apparatus according to the second embodiment.

Furthermore, an outer surface of the front end portion of the die holder 114 is formed to be a concavo-convex face 114*a* made up of a plurality of peripheral grooves, and between the outer surface of the die holder 114 and an inner surface of a front end portion of the die housing 113, a plurality of die engaging members 124 . . . 124 are fit. As shown in FIG. 19, each of the engaging members 124 . . . 124 is shaped to be one of four pieces obtained by dividing a tubular member by 90°. The inner surface of each of the engaging members 124 . . . 124 is formed to be a concavo-convex face 124*a* which engages with the concavo-convex face 114*a* on the outer surface of the front end portion of the die holder 114 when these members are made in contact to each other to form a cylinder.

Figure 20:
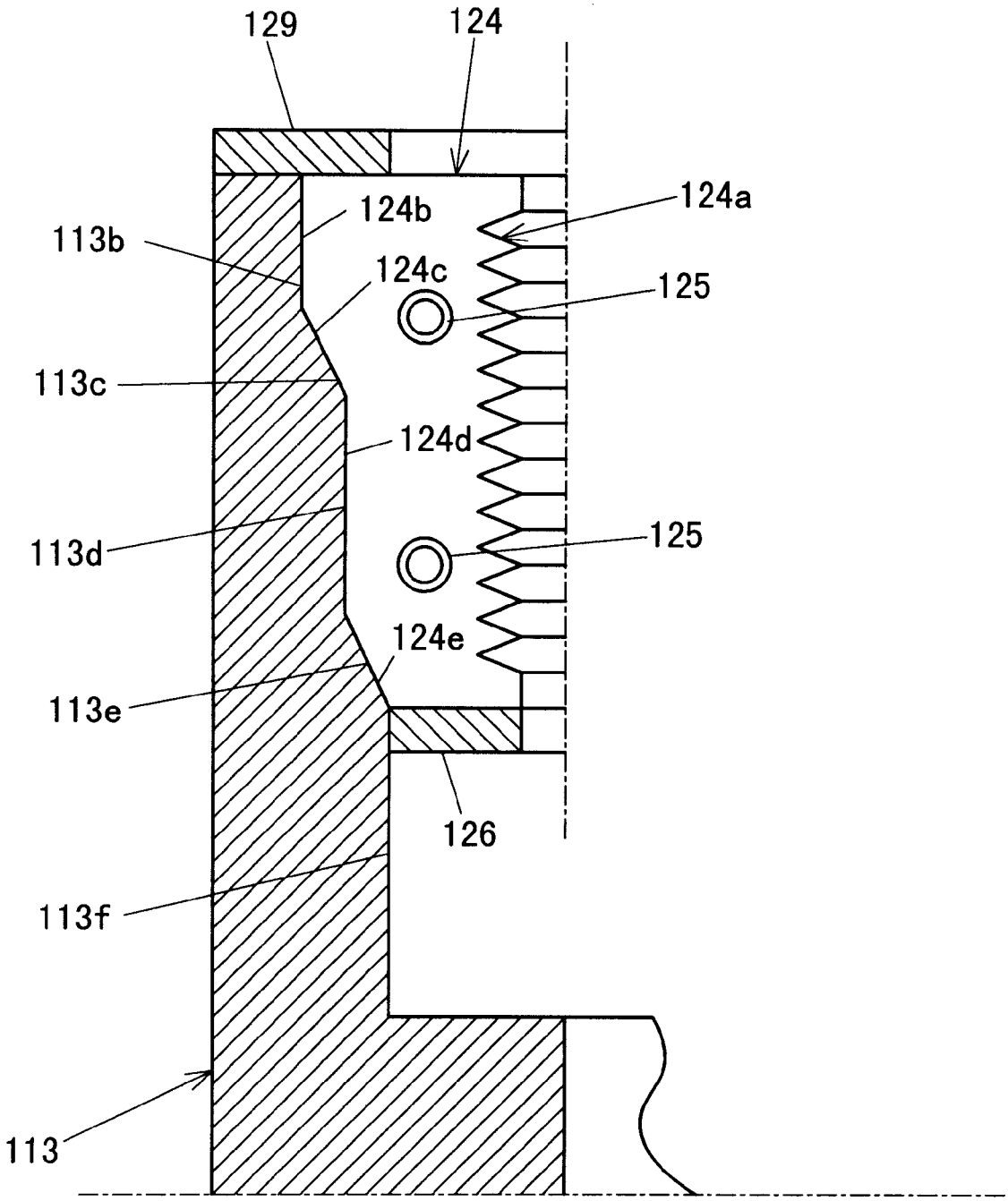
FIG. 20 is an enlarged cross-sectional view, similarly to FIG. 7, showing a die engaging member of the apparatus of the second embodiment of the present invention.

Also as shown in FIG. 20, the outer surface of each of the members 124 . . . 124 is formed as a stepped surface having, from the side of the front end, a first cylindrical face 124*b* with a large diameter, a first tapered face 124*c*, a second cylindrical face 124*d* with a small diameter and a second tapered face 124*e*. Correspondingly, the inner surface of the front end portion of the die housing 113 in which these engaging members 124 . . . 124 are fit is also formed as a stepped surface having, from the side of the front end, a first cylindrical face 113*b* with a large diameter, a first tapered face 113*c*, a second cylindrical face 113*d* with a small diameter, a second tapered face 113*e* and a third cylindrical face 113*f* having a diameter smaller than that of the above second cylindrical face 113*d* such that the engaging member becomes smaller in diameter to the bottom thereof.

As shown in FIG. 19, the adjacent members 124 . . . 124 are connected to each other by means of springs 125 . . . 125 to form an annular quaternion. Then, the springs 125 . . . 125 force the four members 124 . . . 124 so as to increase a diameter of the annular quaternion. Then, as shown FIGS. 18 and 20, with the diameter of the annular quaternion increased, the above first cylindrical face 124*b*, the first tapered face 124*c*, the second cylindrical face 124*d*, and the second tapered face 124*e* of the engaging member 124 come into contact with the first cylindrical face 113*b*, the first tapered face 113*c*, the second cylindrical face 113*d* and the second tapered face 113*e* of the die housing 113, respectively. When each engaging member 124 at the state shown in FIG. 18 is forced into the die housing 113, each member is guided along the contact faces between the first tapered faces 124*c* and 113*c* and between the second tapered faces 124*e* and 113*e* so as to decrease in diameter as a whole.

The rear end portion of the engaging members 124 . . . 124 is supported by a ring member 126 slidably fit in the third cylindrical face 113*f* of the die housing 113. Also as shown in FIG. 18, a rear face of the ring member 126 is in contact with the front end portion of each of a plurality of pins 128 . . . 128 (of which only one is shown in the figure) forced forward by means of springs 127 . . . 127 attached between the ring member 126 and the second pressure receiving member 112, whereby the engaging members 124 . . . 124 are forced forward by means of the springs 127 . . . 127 through the pins 128 . . . 128 and the ring member 126. Then, the forward movement is stopped at a position shown in the figure by a stopper plate 129 provided on the front end face of the die housing 113.

Figure 21:
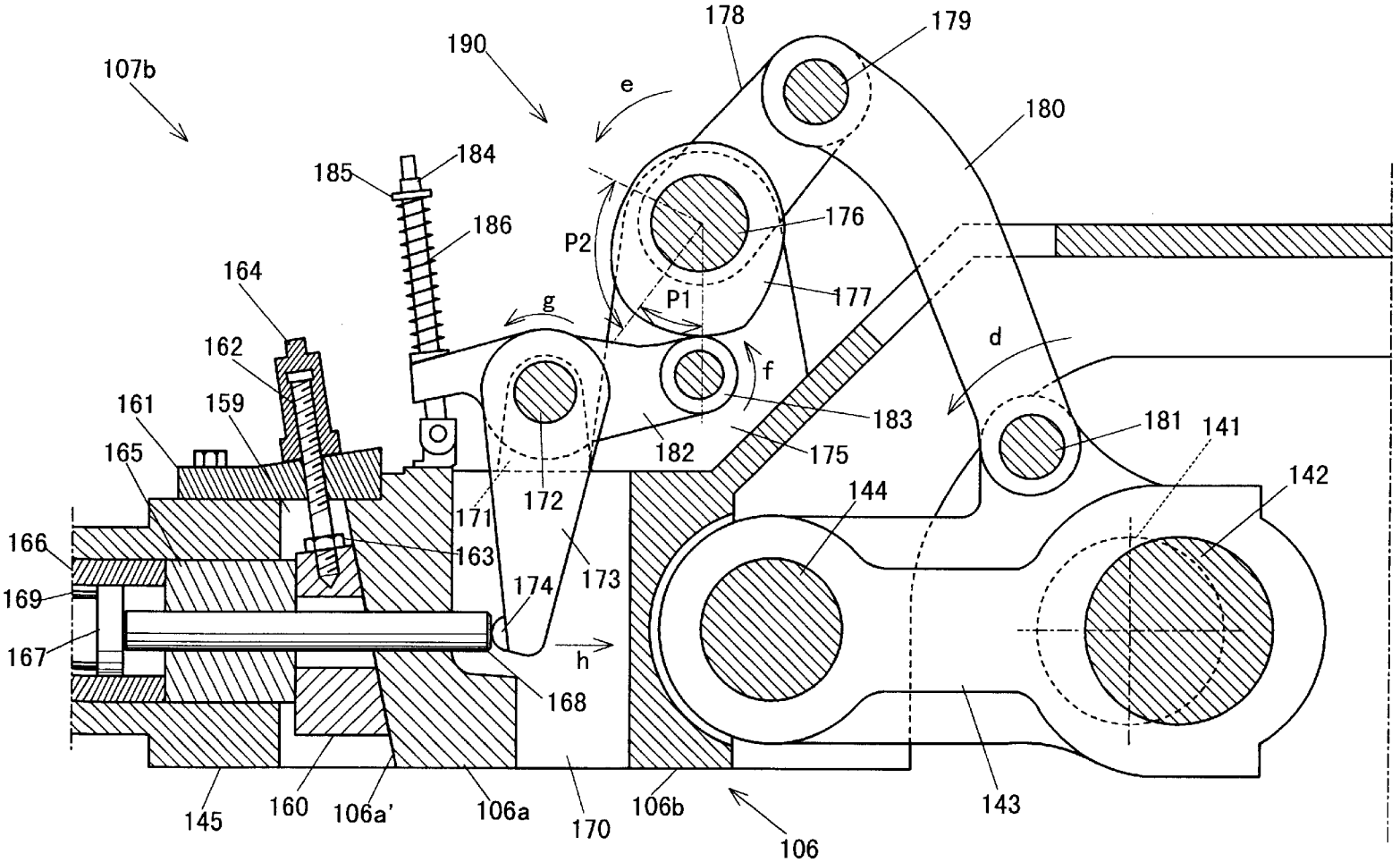
FIG. 21 is a partial cross-sectional view of a movable frame side of the full-enclosed die forging apparatus constituting the second forging station of the second embodiment of the present invention.

Next, the structure of the movable die unit 107*b* will be described. As shown in FIGS. 18 and 21, to a crankshaft 141 eccentrically rotated by a drive shaft (not shown), one end of a connecting rod 143 is connected through a crank pin 142 and to a connecting pin 144 attached to the end of the rod 143, the ram 106 is connected. Therefore, as the crankshaft 141 rotates, the ram 106 moves and the movable die unit 107*b* attached to the ram 106 accordingly moves toward and away from the stationary die unit 105*b* attached to the frame 103.

Then, at the front side of the ram 106, an outer holder 145 is fixed inside of which an inner holder 146 is fit. At the back of the inner holder 146, a receiving member 147 for receiving a front (stationary frame 3 side) load is fixed.

Furthermore, inside the inner holder 146, slidably inserted in the forging direction is a slidable sleeve 148 at the front end of which a die holder 149 is disposed. On the front end of the die holder 149, a movable die 150 is held having a molding concavity equivalent to a shape obtaining by dividing the above intermediate workpiece G in half. An outer peripheral face of the die holder 149 is formed to be a concavo-convex face 149*a* similar to the concavo-convex face 114*a* of the outer surface of the front end of the die holder 114 in the stationary die unit 105*b*.

A front end surface 148*a* of the slidable sleeve 148 faces to the front end surface of the engaging members 124 . . . 124 in the stationary die unit 105*b*, and when the movable die unit 107*b* and the slidable sleeve 148 move forward by a predetermined length, the front end surface 148*a* of the slidable sleeve 148 comes into contact with the front end surface of the engaging members 124 . . . 124 to thrust the engaging members 124 . . . 124 into the die housing 113.

Here, the slidable sleeve 148 has its range of slide member with respect to the inner holder 146 restricted and its rotation stopped by a stop pin 151.

A through hole 152 is provided at the center of the die holder 149 and the movable die 150 to pass through them, and into the through hole 152, a front portion of a movable punch 153 is slidably inserted in the forging direction. Arranged at the back of the movable punch 153 is a subsidiary punch 154 slidably inserted into the slidable sleeve 148. The movable punch 153 is forced forward by means of a spring 155 installed between the punches 153 and 154 up to a position where the tip of the punch 153 projects from the movable die 150 by a predetermined length.

Between spring receiving members 156, 156 attached to the inner holder 146 and spring receiving members 157, 157 attached to the slidable sleeve 148, springs 158, 158 are mounted for forcing the inner holder 146 toward the receiving member 147.

On the other hand, between the outer holder 145 and the ram 106, a tapered groove 159 is formed in which an up-and-down movable tapered member 160 is disposed in contact with a tapered face 106*a* on the ram 106 side, and a base member 161 is fixed over the upper surfaces of both the outer holder 145 and the ram 106. Then, on the upper surface of the tapered member 160, a screw spindle 162 is attached whose rotation is stopped by a lock nut 163, and a nut-like member 164 is engaged with the upper end part of the screw spindle 162 upwardly projecting through the base member 161. Thus, by rotating the nut-like member 164 by an appropriate means to move the tapered member 160 up and down, the receiving member 147 can be moved together with the subsidiary punch 154 in the forging direction through a first press member 165 and a sleeve member 166 provided between the tapered member 160 and the back of the receiving member 147, thereby enabling adjustment of punch attachment position.

Within the sleeve member 166, a second press member 167 is slidably inserted in a forging direction with respect to the sleeve member 166, and provided in contact with the rear end surface of the second press member 167 is a tip portion of a driving rod 168 moving integrally with and according to the slidable sleeve 148, while between the second press member 167 and the slidable sleeve 148, pins 169 . . . 169 are provided passing through the receiving member 147.

Furthermore, between a base part 106*b* and a front part 106*a* of the ram 106, a void space 170 is formed and above the space 170, a supporting shaft 172 is rotatably arranged in perpendicular to the direction of forward and backward movement of the ram 106 between a pair of brackets 171 (only one is shown) standing on the upper surface of the ram 106. Then, to the supporting shaft 172, a driving lever 173 is attached whose one end trails into the void space 170 to be in contact with the rear end of the driving rod 168 with a cushioning member 174 provided therebetween.

Accordingly, a rod hole is formed integrally passing through the first press member 165, the tapered member 160 and the ram front part 106*a*, into which hole the driving rod 168 is slidably inserted. Then, moving the driving rod 168 in the forging direction by the driving lever 173 results in having the second press member 167 and the pins 169 . . . 169 move integrally with the driving rod 168, whereby the slidable sleeve 148 moves in the forging direction together with the dice 150.

Furthermore, above the supporting shaft 172 and at a position closer to the connecting pin 144, a camshaft 176 is rotatably arranged in parallel to the supporting shaft 172 similarly between a pair of brackets 175 (only one is shown) standing on the upper surface of the ram 106, and a cam plate 177 is attached to the camshaft 176. The cam plate 177 or the cam shaft 176 is provided with a lever 178 to one end of which one end of a connecting link 180 is rotatably supported through a connecting pin 179 and the other end of the connecting link 180 is rotatably supported at the connecting rod 143 at a position close to the crankshaft 141 by means of a connecting pin 181. As a result, of the movement by eccentric rotation of the crankshaft 141, force of a vertical direction movement component is taken out to the camshaft 176 through the connecting link 180 to rotate the cam plate 177.

In this case, with the plane of cam action of the cam plate 177, a cam-follower 183 contacts which is provided at one end of a driving arm 182 attached to the supporting shaft 172. For forcing the cam-follower 183 always to a direction that makes the follower be in contact with the cam plate 177, a rod 184 stands on the upper surface of the ram 106. The rod 184 passes through the other end portion of the driving arm 182 and a coil spring 186 is provided between a receiving member 185 at the tip of the rod and the other end portion of the driving arm 182. With this arrangement, movement of the driving arm 182 is absorbed by the coil spring 186 and the cam-follower 183 is always forced to a direction that makes the follower be in contact with the cam plate 177.

Thus, a cam mechanism 190 responsible for the above differential operation is made up of the cam plate 177, the driving rod 168, the driving lever 173 and the driving arm 182.

Description will be next made of operation of the multi-stage forging apparatus 101, particularly, of the second forging station X102 for conducting full-enclosed die forging.

As shown in FIGS. 18 and 21, when the cylindrical material F is transferred to the second forging station X102 from the first forging station X101 by an automatic transfer device not shown, the movable die unit 107*b* moves forward together with the ram 106, whereby the movable punch 153 of the movable die unit 107*b* drives the material F into the die 117 of the stationary die unit 105*b* and into the hole 118 at the center of the die holder 114 to hold the material F between the front end of the punch 153 and the front end of the stationary punch 121 in the hole 118.

Figure 22:
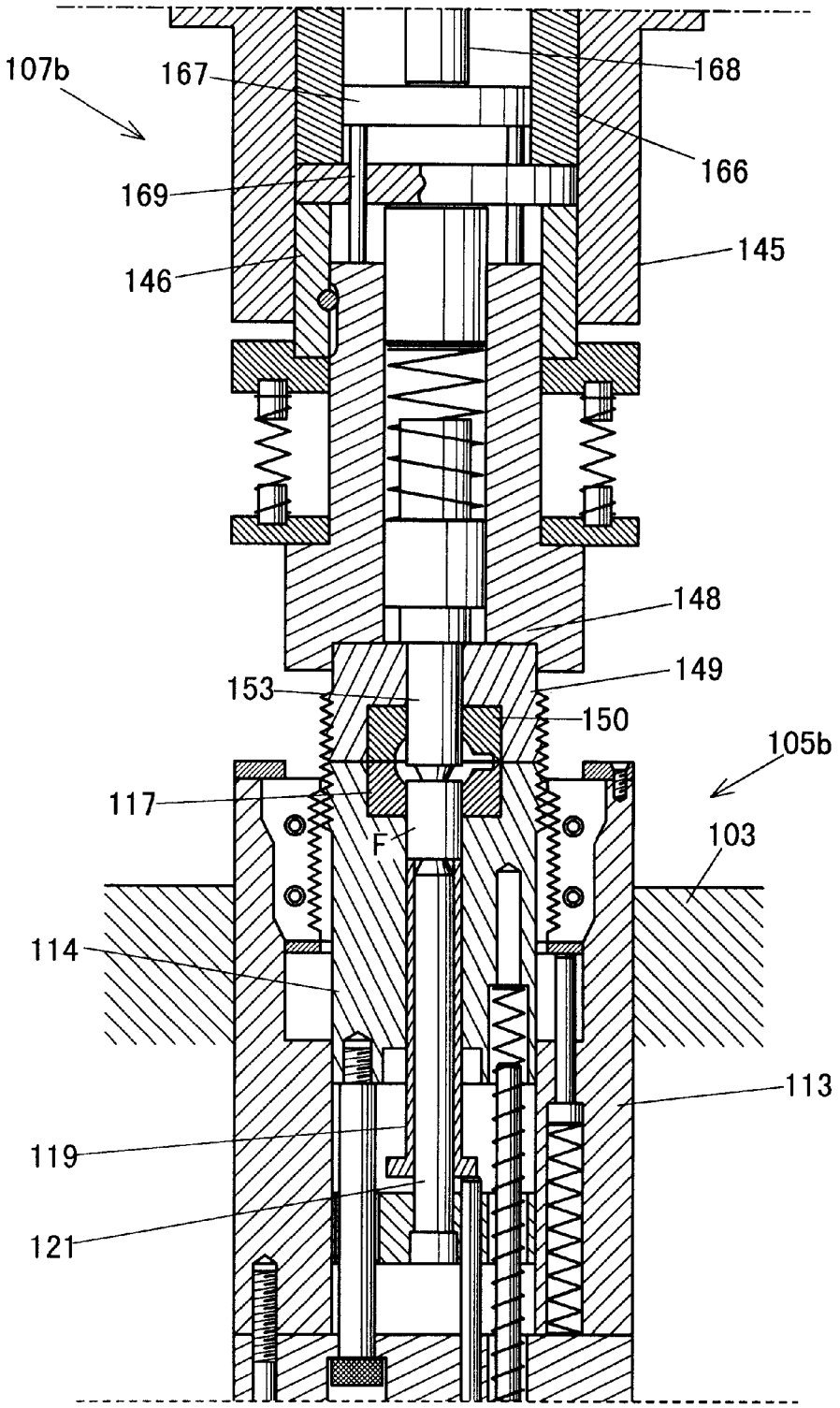
FIGS. 22 to 25 are cross-sectional views, similarly to FIGS. 9 to 12, showing forging operation of the apparatus of the second embodiment step by step.

Then, as shown in FIG. 22, the front faces of the die holder 149 and the movable die 150 held by the die holder 149 in the movable die unit 107*b* come into contact with the front faces of the die holder 114 and the stationary die 117 held by the holder 114 in the stationary die unit 105*b* to form a cavity of a predetermined shape by the closed pair of dies 117 and 150.

Figure 23:
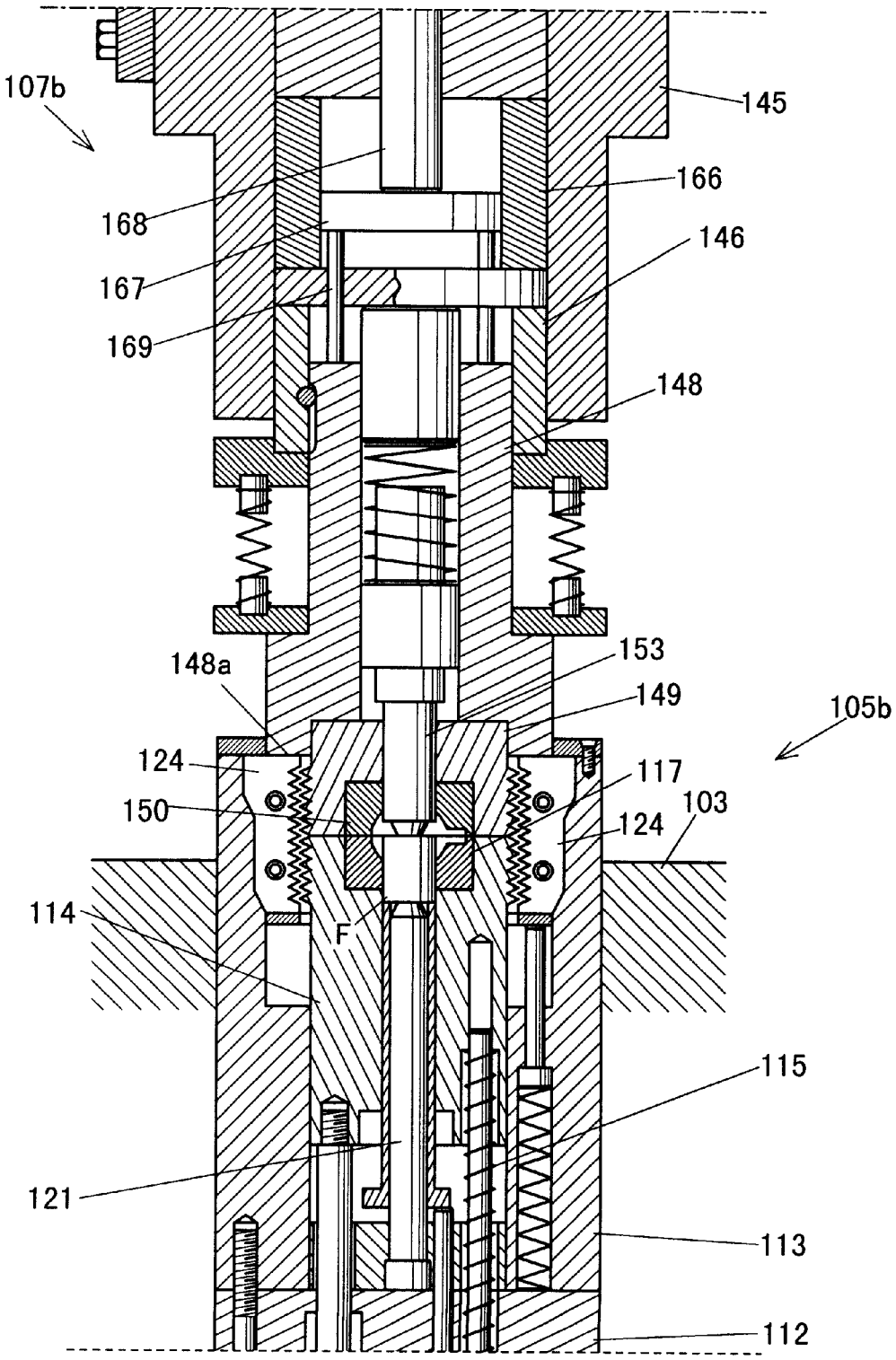

At this state, when the ram 106 moves forward further, as shown in FIG. 23, the closed pair of dies 117 and 150 whose front end surfaces are in contact with each other are thrust into the die housing 113 on the stationary die unit 105*b* against the biasing force of the spring 115 and when the closed pair of dies 117 and 150 are thrust by a predetermined length, the front face 148*a* of the slidable sleeve 148 in the movable die unit 107*b* comes into contact with the front faces of the four die engaging members 124 . . . 124 housed in the die housing 113.

Also at this time, the rear end of the stationary punch 121 comes into contact with the second pressure receiving member 112 to prevent the movable punch 153 from moving forward through the stationary punch 121 and the material F.

Figure 24:
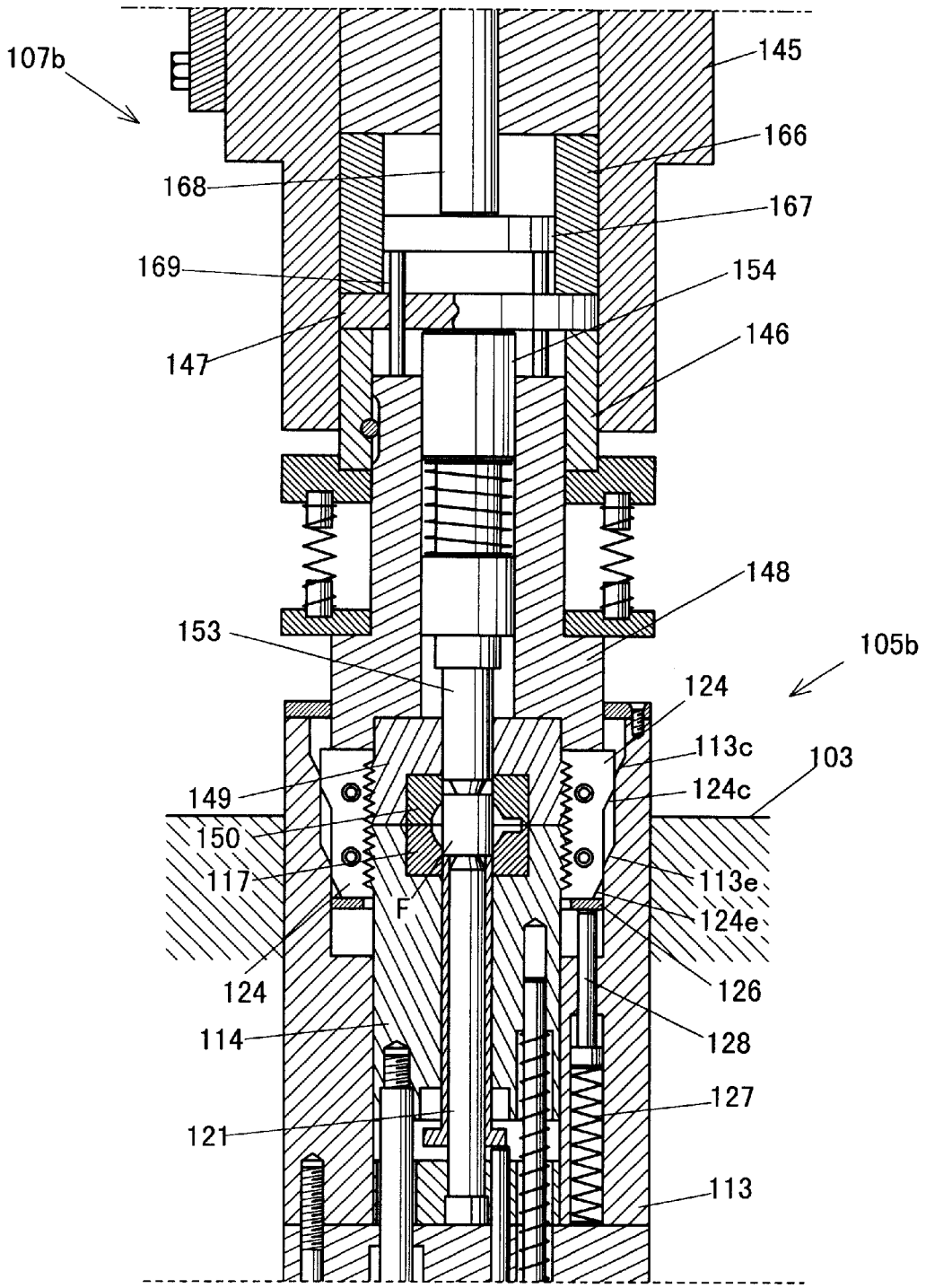

Then, at this state, when the ram 106 moves forward further, as shown in FIG. 24, the slidable sleeve 148 thrusts the die engaging members 124 . . . 124 backward into the die housing 113 against the biasing force of the spring 127. On this occasion, these engaging members 124 . . . 124 have their first and second the tapered faces 124*c* and 124*e* of the outer surface guided by the first and the second tapered faces 113*c* and 113*e* of the inner surface of the die housing 113 to decrease in diameter as a whole against the biasing force of the springs 125 . . . 125 shown in FIG. 19.

As a result, the concavo-convex faces 124*a* . . . 124*a* formed on the inner surfaces of the members 124 . . . 124 engage with the concavo-convex faces 114*a* and 149*a* on the outer surfaces of the die holders 114 and 149 on the stationary and movable sides to mechanically join the pair of die holders 114 and 149, thereby reliably maintaining the cavity formed by the pair of the die holders 114 and 149 at a closed state.

While the pair of closed die holders 114 and 149 are thrust backward into the die housing 113 as shown in FIGS. 23 and 24, the movement of the punches 121 and 153 is prevented, so that the material F held between the punches 121 and 153 will be relatively introduced into the center of the cavity from the hole 118 of the die holder 113. Upon positioning of the material F at the center of the cavity as shown in the figure, the subsidiary punch 154 of the movable die unit 107*b* comes into contact with the rear end of the movable punch 153, whereby the movable punch 153 moves forward integrally with the ram 106.

Here, operation of the cam mechanism 190 will be described with reference to FIG. 21. First, according to the forward movement of the ram 106, the connecting link 180 moves in a direction indicated by an arrow "d", whereby the cam plate 177 rotates in a direction indicated by an arrow "e" through the lever 178. At this time, a plane P1 of cam action of the cam plate 176 at the states shown in FIG. 18 through FIG. 23 is formed to prevent the cam-follower 183 from oscillating. As a result, the driving lever 173 will not oscillate, so that the movable die 150 advances at the same speed as the advancement speed of the ram 106.

Next, from the state shown in FIG. 23 to the state shown in FIG. 24, as the ram 106 moves forward further, the cam plate 177 rotates in a direction indicated by the arrow "e". At this time, a plane P2 of cam action of the cam plate 176 is formed to allow the cam-follower 183 to oscillate in a direction indicated by an arrow "f". As a result, as the driving arm 182 rotates the supporting shaft 172 in a direction indicted by an arrow "g", the driving lever 173 moves to a direction indicated by an arrow "h" and the driving rod 168 accordingly moves to the direction indicated by the arrow "h".

As a result, the pair of dies 117 and 150 moving integrally with the slidable sleeve 148 is thrust into the die housing 113 at half the advancement speed of the movable punch 153 moving integrally with the ram 106.

Figure 25:
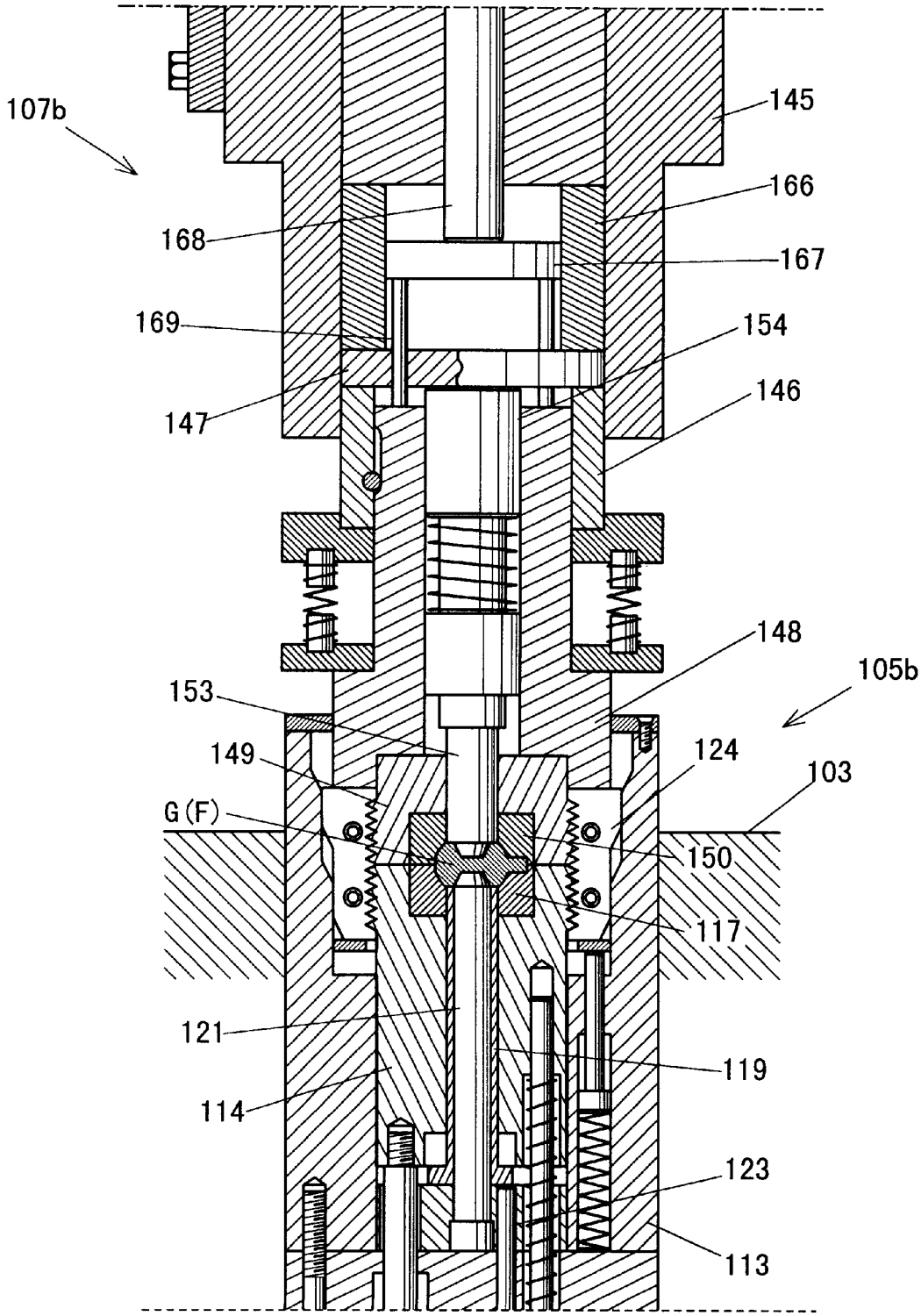

Accordingly, as shown in FIG. 25, the material F in the cavity is pressed equally from the opposite ends thereof by the stationary punch 121 and the movable punch 153, so that a concavity is formed satisfactorily on each end of the workpiece and arms are formed satisfactorily on the outer surface. Especially in such a case as this where a workpiece having a plurality of arms radially projecting is to be formed, when the amount of flow of the material is large, the workpiece can be molded satisfactorily as well.

In a manner as described above, the intermediate workpiece G having the concavities G", G" on its opposite ends and a plurality of arms G' . . . G' projecting radially provided on its peripheral face is formed as shown in FIG. 16. Thereafter, the ram 106 moves backward and the pair of dies 117 and 150 move toward the ram 106 side and in the meantime, the quaternion of the engaging members 124 . . . 124 expand to release the joining of the pair of dies 117 and 150. Then, the ram 106 moves backward further, so that the movable die 150 moves away from the stationary die 117 and the knockout pin 122 starts operating, whereby the intermediate workpiece G is taken out from the stationary die 117 through the KO rod 123 and the eject sleeve 119.

Then, the intermediate workpiece G is transferred to the third forging station X103 where the finished workpiece H is formed by piercing the concavities G", G" on the opposite ends to have the through hole H'.

Thus, such workpiece H as shown in FIG. 17 is formed sequentially and successively. According to the above-described structure, only the forwarding operation of the ram 106 results in having a series of operation conducted at the second forging station X102 to close the stationary die 117 and the movable die 150 and mechanically join the pair of dies 117 and 150 by means of the engaging members 124 . . . 124 and to forge the material F in the cavity equally from the opposite ends thereof by the differential mechanism of the pair of dies 117 and 150 and the movable punch 153.

In addition, because the cam mechanism 190 for the above differential operation has a simple structure made of the cam plate 177, the driving rod 168, the driving lever 173 and the driving arm 182 and also because it is operated by a driving means (not shown) which moves the ram 106, it is unlikely that the forging station X102 becomes complicated in structure or large-scaled because of the provision of the differential mechanism.

Thus, the above-described full-enclosed die forging will be conducted satisfactorily in the multi-stage forging apparatus 101 having the plurality of forging stations without affecting working and layout of adjacent stations and without causing the apparatus 101 to be large-scaled.

Then, since the cam mechanism 190 is attached to the ram 106 on the side of the movable die unit 107*b*, it is not a hindrance to arrangement and operation of the transfer device provided in the stationary frame 103 for transferring a material sequentially from an upstream station to a downstream station.

In addition, although the forgoing description has been made assuming that the pair of dies 117 and 150 move at half the advancement speed of the movable punch 153, replacement by the cam plate 177 having a different plane of cam action enables the pair of dies 117 and 150 to move at an arbitrary speed lower than the moving speed of the movable punch 153, as well as enabling the timing when the dies 117 and 150 start differential operation to be arbitrarily set.

The above-described embodiment is structured such that the movable punch 153 moves integrally with the ram 106 and the cam mechanism 190 operating according to the movement of the ram 106 slows the moving speed of the pair of dies 117 and 150 to make the movable punch 153 and the pair of dies 117 and 150 have differential operation. Another mode related to this embodiment is making the movable punch 153 and the pair of dies 117 and 150 have differential operation by another driving means, which will be described with reference to FIG. 26.

In the following description, the common components to those of the above embodiment are given the same reference numerals and detailed description of overlapping parts will be omitted.

Figure 26:
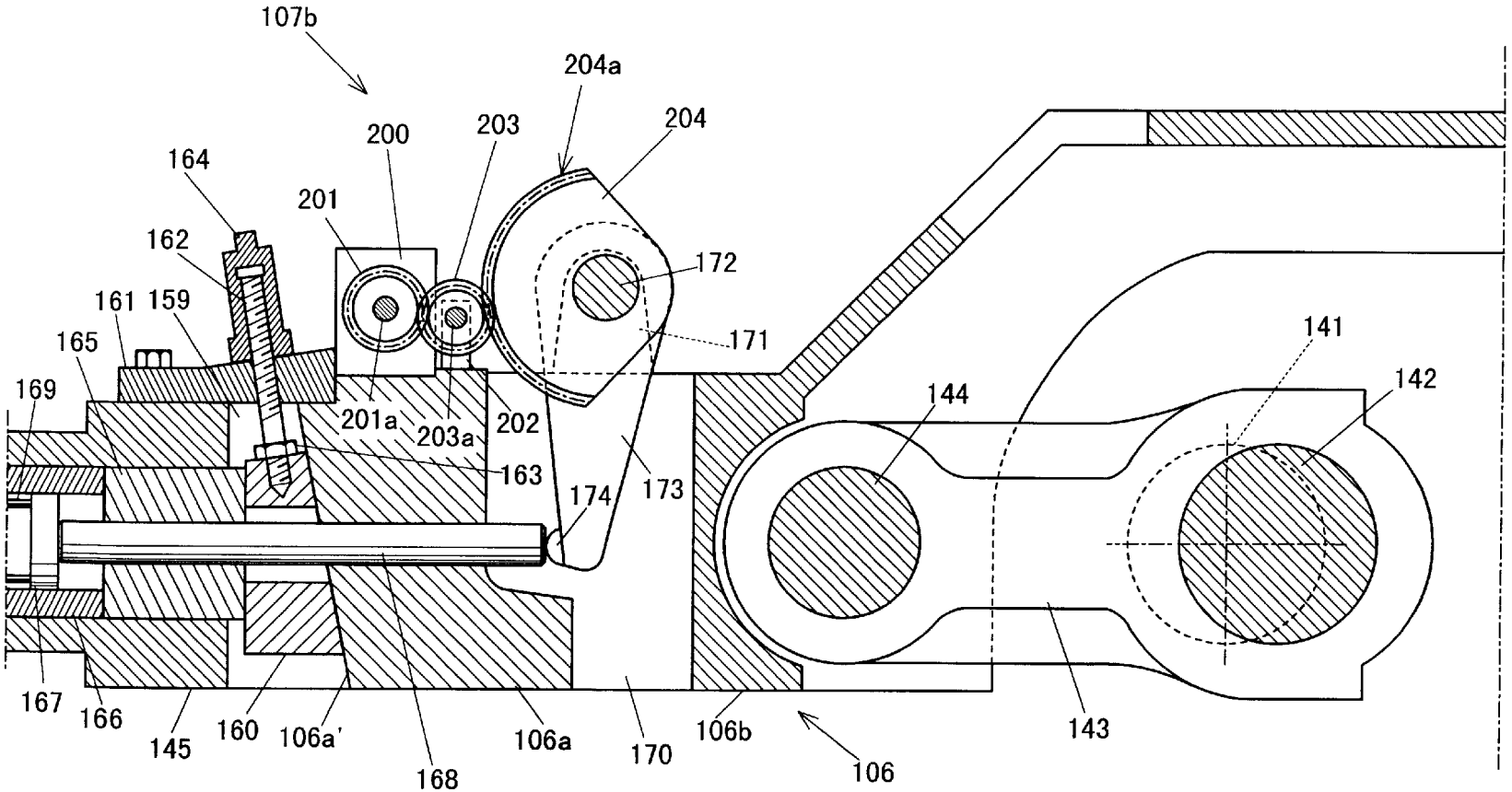
FIG. 26 is a cross-sectional view corresponding to FIG. 21, which shows another mode related to the present invention.
Figure 27:
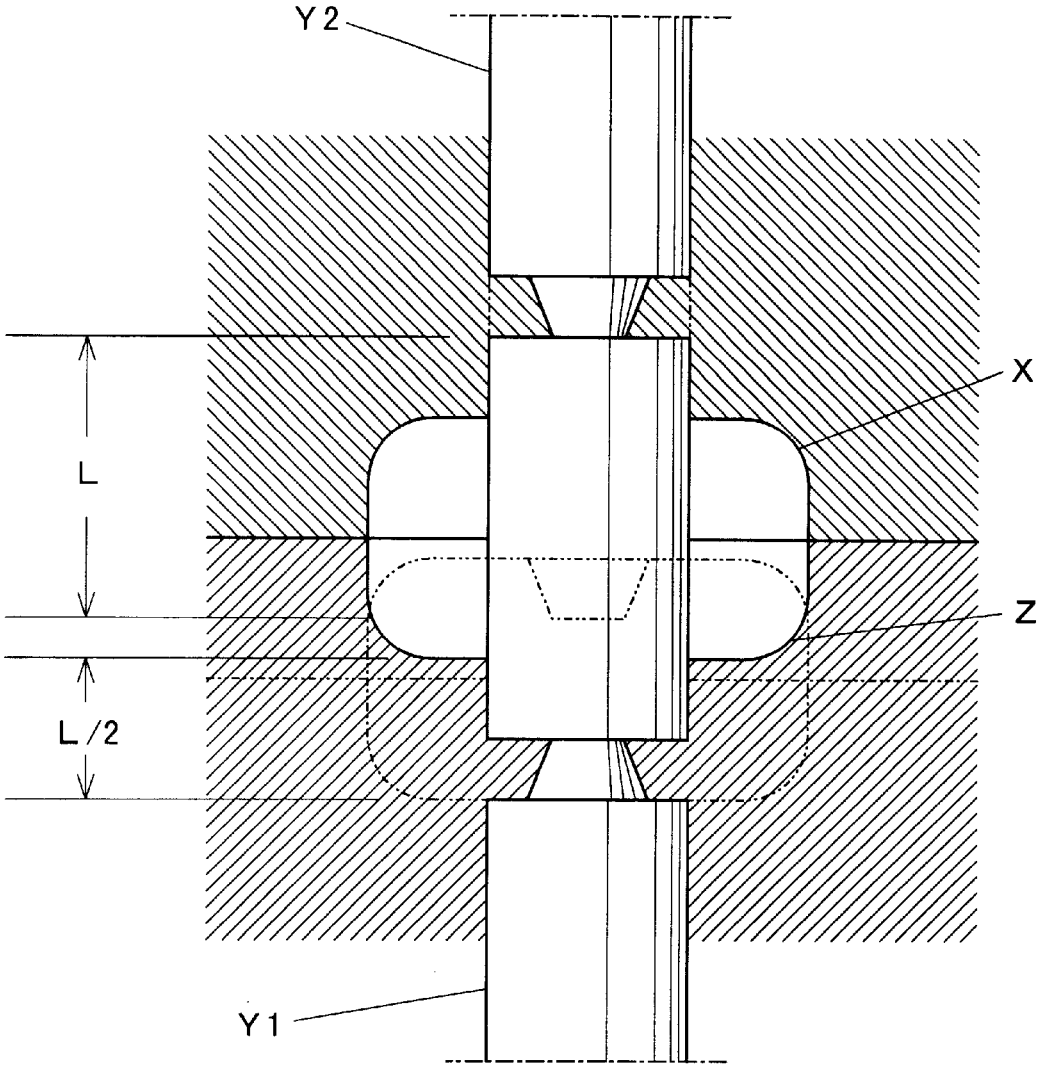
FIG. 27 is a view for use in explaining a full-enclosed die forging apparatus having a differential mechanism.

As shown in FIG. 26, on the upper surface of the front side of the ram 106, a servo motor 200 is arranged which is provided with a drive shaft 201*a* driven by the motor 200, and a driving gear 201 is attached to the drive shaft 201*a*. In addition, between brackets 202 (one of which is shown), a mediating gear shaft 203*a* is rotatably supported to which a mediating gear 203 is attached. The mediating gear 203 and the driving gear 201 gear with each other. Moreover, at a supporting shaft 172, a sector gear 204 is rotatably supported whose gear tooth 204*a* gears with the mediating gear 203.

With the above arrangement, as the driving gear 201 rotates by the driving of the servo motor 203, the sector gear 204 rotates through the mediating gear 203. As a result, a driving lever 173 attached to the supporting shaft 172 oscillates to move a driving rod 168 in contact with the driving lever 173 forward and backward.

As a result, provision of other driving means than the driving means which drives the ram 106 enables a thrusting speed of a pair of dies moving integrally with the driving rod 168 into the die housing to be arbitrarily set as a speed lower than that of the movable punch moving integrally with the ram 106 and to be accurately set, as well as enabling timing when both the dies start differential operation to be arbitrarily set with ease.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An apparatus for full-enclosed die forging, comprising:

a first die on a stationary frame;

a second die on a movable frame which moves toward and away from the stationary frame to come into and out of contact with the first die; and a first punch on the stationary frame and a second punch on the movable frame which plunge into a cavity formed by the closed pair of these dies from the opposite sides, thereby forging a material into a workpiece having concavities on its opposite end surfaces; wherein the first die is movable in a forging direction in a die housing provided on the stationary frame and is biased to the second die by a first spring member, and a plurality of die engaging members in the die housing adjacent the first die and which are biased into the die housing, and the second die is attached to a slide member provided slidably in the forging direction on the movable frame and is forced together with the slide member to the first die by a second spring member, and a thrusting portion on the slide member for thrusting the die engaging members inside the die housing to engage the die engaging members with the first and the second dies after the first die and the second die are closed to each other in the process of the advancement of the movable frame, and further comprising:

a differential mechanism for causing the slide member to move forward according to the advancement movement of the movable frame at a speed slower than the speed of the movable frame after the die engaging members are engage with the first and the second dies, thereby, with the first punch fixed and the second punch on the movable frame side advancing integrally with the movable frame, allowing the first and second dies advancing integrally with the slide member to move toward the first punch at a speed slower than that of the second punch.

2. The apparatus for full-enclosed die forging according to claim 1, wherein the differential mechanism comprises:

a link member having a central portion and opposite end portions, the central portion being rotatably supported by the slide member, and receiving portions on the stationary frame side and the movable frame side which come into contact with the opposite end portions of the link member, respectively, thereby when the receiving portion on the movable frame approaches the receiving portion at an approaching speed with the advancement of the movable frame, causing the slide member to move forward at a speed slower than that of the approaching speed.

3. The apparatus for full-enclosed die forging according to claim 1, wherein said differential mechanism comprises:

first and second link members each having one end rotatably connected to the same fulcrum of said movable frame, third and fourth link members each having one end connected to said first and second link members, respectively, and the other end connected to each other to form a quaternion link mechanism together with said first and second link members, a guide member fixed to said slide member for supporting a connection point between said first link member and said third link member and a connection point between said second link member and said fourth link member so as to move in a direction perpendicular to a direction of the forward movement of the movable frame, and a receiving portion provided on the stationary frame to come into contact with a connection point between said third link member and said forth link member at the time of advancement of the movable frame, thereby advancing the slide member at a speed lower than that of the movable frame upon contact between said connection point and said receiving portion.

4. The apparatus for full-enclosed die forging according to claim 1, wherein the apparatus is provided in a multi-stage forging apparatus having a plurality of forging stations to which materials are supplied sequentially for constituting one of the forging stations.

5. An apparatus for full-enclosed die forging, comprising:

a first die on a stationary frame;

a second die on a movable frame which moves toward and away from the stationary frame to come into and out of contact with the first die; and a first punch on the stationary frame and a second punch on the movable frame which plunge into a cavity formed by the closed first and second dies from opposite sides, thereby forging a material into a workpiece of predetermined shape; wherein the first die is movable in a forging direction in a die housing provided on the stationary frame and is biased to the second die by a first spring member, and a plurality of engaging members in the die housing adjacent the first die and which are biased into the die housing, and the second die is attached to a slide member provided slidably in the forging direction on the movable frame and is forced together with the slide member to the first die by a second spring member, and a thrusting portion on the slide member thrusting the engaging members inside the die housing to engage the die engaging members with the first and the second dies after the first die and the second die are closed to each other in the process of the advancement of the movable frame, and further comprising:

a cam mechanism having a rod member which is provided at the back of the slide member on the movable frame which moves integrally with the slide member and operable to cause the slide member to move backward relative to the movable frame through the rod member according to the movement of the movable frame, thereby advancing the slide member at a speed slower than the movable frame, with the die engaging members engaged with the first and second dies and with the first punch on the stationary frame fixed and the second punch on the movable frame side advancing integrally with the movable frame.

6. The apparatus for full-enclosed die forging according to claim 5, wherein the apparatus is provided in a multi-stage forging apparatus having a plurality of forging stations to which materials are supplied sequentially for constituting one of the forging stations.

* * * * *